US010655468B2

(12) United States Patent
Siegrist et al.

(10) Patent No.: US 10,655,468 B2
(45) **Date of Patent: *May 19, 2020**

(54) HORIZON MONITORING FOR LONGWALL SYSTEM

(71) Applicant: Joy Global Underground Mining LLC, Warrendale, PA (US)

(72) Inventors: Paul M. Siegrist, Brisbane (AU); Nigel J. Buttery, South Brisbane (AU); Lachlan Palmer, Queensland (AU)

(73) Assignee: Joy Global Underground Mining LLC, warrendale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/456,819

(22) Filed: Jun. 28, 2019

(65) Prior Publication Data

US 2019/0323348 A1 Oct. 24, 2019

Related U.S. Application Data

(63) Continuation of application No. 16/107,688, filed on Aug. 21, 2018, now Pat. No. 10,378,356, which is a (Continued)

(51) Int. Cl.
*G08B 25/00* (2006.01)
*E21F 17/18* (2006.01)

(Continued)

(52) U.S. Cl.
CPC ..... *E21F 17/18* (2013.01); *E21C 25/06* (2013.01); *E21C 35/24* (2013.01)

(58) Field of Classification Search
CPC ..... E21C 35/24; E21C 25/06; E21C 27/32; E21F 17/18

(Continued)

(56) References Cited

U.S. PATENT DOCUMENTS 3,922,015 A 11/1975 Poundstone
4,008,921 A 2/1977 Czauderna et al.

(Continued)

FOREIGN PATENT DOCUMENTS

CN 201433792 3/2010
CN 102061921 5/2011

(Continued)

OTHER PUBLICATIONS

Search Report from the United Kingdom Intellectual Property Office for Application No. GB1514307.6 dated Jan. 22, 2016 (3 pages).

(Continued)

*Primary Examiner* — Daniel Previl
(74) *Attorney, Agent, or Firm* — Michael Best & Friedrich LLP

(57) ABSTRACT

A method of monitoring a longwall shearing mining machine in a longwall mining system, wherein the shearing mining machine includes a shearer having a first cutter drum and a second cutter drum, includes receiving, by a processor, shearer position data over a shear cycle. The horizon profile data includes information regarding at least one of the group comprising of a position and angle of the shearer, a position of the first cutter drum, and a position of the second cutter drum. The method also includes analyzing the shearer position data, by the processor, to determine whether a position failure occurred during the shear cycle based on whether the computed horizon profile data was within normal operational parameters during the shear cycle, and generating an alert upon determining that the position failure occurred during the shear cycle.

20 Claims, 28 Drawing Sheets

Related U.S. Application Data continuation of application No. 15/651,422, filed on Jul. 17, 2017, now Pat. No. 10,082,026, which is a continuation of application No. 14/839,599, filed on Aug. 28, 2015, now Pat. No. 9,726,017.

(60) Provisional application No. 62/043,387, filed on Aug. 28, 2014.

(51) Int. Cl.
*E21C 25/06* (2006.01)
*E21C 35/24* (2006.01)

(58) Field of Classification Search
USPC ..... 340/686.1, 687, 686.6, 691.1, 691.6, 340/691.8, 3.42, 825.23, 5.1, 5.23, 5.5
See application file for complete search history.

(56) References Cited

U.S. PATENT DOCUMENTS

| | | | | |
|---|---|---|---|---|
| 4,023,861 | A | 5/1977 | Schnell | |
| 4,079,997 | A | 3/1978 | Bienko et al. | |
| 4,143,552 | A | 3/1979 | Godfrey | |
| 4,192,551 | A | 3/1980 | Weimer et al. | |
| 4,200,335 | A | 4/1980 | Moynihan et al. | |
| 4,323,280 | A | 4/1982 | Lansberry et al. | |
| 4,581,712 | A | 4/1986 | Perry et al. | |
| 4,634,186 | A | 1/1987 | Pease | |
| 4,753,484 | A | 6/1988 | Stolarczyk et al. | |
| 4,822,105 | A | 4/1989 | Yamada et al. | |
| 5,228,751 | A | 7/1993 | Ramsden, Jr. | |
| 5,268,683 | A * | 12/1993 | Stolarczyk | E21C 35/24 175/40 |
| 5,448,479 | A | 9/1995 | Kemner et al. | |
| 5,469,356 | A | 11/1995 | Hawkins et al. | |
| 5,586,030 | A | 12/1996 | Kemner et al. | |
| 5,615,116 | A | 3/1997 | Gudat et al. | |
| 5,646,845 | A | 7/1997 | Gudat et al. | |
| 5,648,901 | A | 7/1997 | Gudat et al. | |
| 5,838,562 | A | 11/1998 | Gudat et al. | |
| 5,877,723 | A | 3/1999 | Fan | |
| 5,906,646 | A | 5/1999 | Kemner | |
| 5,913,914 | A | 6/1999 | Kemner et al. | |
| 5,925,081 | A | 7/1999 | Hawkins et al. | |
| 5,956,250 | A | 9/1999 | Gudat et al. | |
| 5,961,560 | A | 10/1999 | Kemner | |
| 5,967,616 | A | 10/1999 | Offutt et al. | |
| 6,002,362 | A | 12/1999 | Gudat | |
| 6,132,005 | A | 10/2000 | Mazlin et al. | |
| 6,351,697 | B1 | 2/2002 | Baker | |
| 6,361,119 | B1 | 3/2002 | Kussel | |
| 6,393,362 | B1 | 5/2002 | Burns | |
| 6,442,456 | B2 | 8/2002 | Burns et al. | |
| 6,612,655 | B2 | 9/2003 | Schwoebel et al. | |
| 6,633,800 | B1 | 10/2003 | Ward et al. | |
| 6,666,521 | B1 | 12/2003 | Pease et al. | |
| 6,694,233 | B1 | 2/2004 | Duff et al. | |
| 6,799,100 | B2 | 9/2004 | Burns et al. | |
| 6,857,705 | B2 | 2/2005 | Hainsworth | |
| 7,181,370 | B2 | 2/2007 | Furem et al. | |
| 7,574,821 | B2 | 8/2009 | Furem | |
| 7,578,079 | B2 | 8/2009 | Furem | |
| 7,656,342 | B2 | 2/2010 | Stolarczyk et al. | |
| 7,659,847 | B2 | 2/2010 | Bausov et al. | |
| 7,695,071 | B2 | 4/2010 | Jackson et al. | |
| 7,725,232 | B2 | 5/2010 | Mäkelä et al. | |
| 7,899,599 | B2 | 3/2011 | Mäkelä et al. | |
| 8,157,331 | B2 | 4/2012 | Niederriter et al. | |
| 8,376,467 | B2 | 2/2013 | Junker et al. | |
| 8,562,077 | B2 | 10/2013 | Junker et al. | |
| 8,567,870 | B2 | 10/2013 | Junker et al. | |
| 8,708,421 | B2 | 4/2014 | Junker | |
| 9,506,343 | B2 | 11/2016 | Ley et al. | |
| 9,726,017 | B2 * | 8/2017 | Siegrist | E21F 17/18 |
| 10,082,026 | B2 * | 9/2018 | Siegrist | E21F 17/18 |
| 10,378,356 | B2 * | 8/2019 | Siegrist | E21C 35/24 |
| 2007/0216216 | A1 | 9/2007 | Baird, Jr. et al. | |
| 2009/0134692 | A1 | 5/2009 | Hargrave et al. | |
| 2010/0114808 | A1 | 5/2010 | Mintah | |
| 2010/0138094 | A1 | 6/2010 | Stark et al. | |
| 2010/0276981 | A1 * | 11/2010 | Kussel | E21D 23/12 299/1.3 |
| 2011/0153541 | A1 | 6/2011 | Koch et al. | |
| 2011/0248548 | A1 | 10/2011 | Junker et al. | |
| 2011/0253502 | A1 | 10/2011 | Neilson et al. | |
| 2012/0098325 | A1 | 4/2012 | Junker et al. | |
| 2012/0146387 | A1 | 6/2012 | Shatters | |
| 2012/0170981 | A1 | 7/2012 | Weigel et al. | |
| 2012/0191431 | A1 | 7/2012 | Dunbabin et al. | |
| 2012/0305025 | A1 | 12/2012 | Helbig et al. | |
| 2013/0006484 | A1 | 1/2013 | Avitzur et al. | |
| 2013/0068594 | A1 | 3/2013 | Worthington et al. | |
| 2013/0197737 | A1 * | 8/2013 | Malayappalayam Shanmugam | E21F 17/18 701/29.1 |
| 2013/0285573 | A1 | 10/2013 | Paterson | |
| 2015/0056583 | A1 * | 2/2015 | Felege | G09B 9/05 434/219 |
| 2016/0061031 | A1 | 3/2016 | Ley et al. | |
| 2016/0061035 | A1 | 3/2016 | Siegrist et al. | |
| 2016/0123145 | A1 | 5/2016 | Westphalen et al. | |

FOREIGN PATENT DOCUMENTS

| | | | |
|---|---|---|---|
| CN | 102102512 | A | 6/2011 |
| CN | 102287186 | A | 12/2011 |
| CN | 102797462 | A | 11/2012 |
| CN | 103728147 | | 4/2014 |
| CN | 103742142 | | 4/2014 |
| CN | 103775080 | A | 5/2014 |
| CN | 103835719 | A | 6/2014 |
| DE | 4142165 | A1 | 4/1993 |
| DE | 4234720 | A1 | 4/1994 |
| DE | 4439601 | A1 | 5/1996 |
| GB | 2103265 | A | 2/1983 |
| PL | 394472 | A1 | 10/2012 |
| RU | 2360111 | C2 | 6/2009 |
| SU | 1523661 | A1 | 11/1989 |
| WO | 9624753 | | 8/1996 |
| WO | 2010037491 | A1 | 4/2010 |

OTHER PUBLICATIONS

Search Report from the Polish Patent Office for Application No. P-413691 dated Mar. 15, 2016 (2 pages).
Search Report from the Polish Patent Office for Application No. P-413683 dated Mar. 16, 2016 (2 pages).
Corrected Search Report from the British Patent Office for Application No. GB1514307.6 dated Feb. 18, 2016 (2 pages).
United States Patent Office Action for U.S. Appl. No. 14/839,599 dated Oct. 6, 2016 (8 pages).
United States Patent Office Action for U.S. Appl. No. 15/651,422 dated Jan. 31, 2018 (6 pages).
First Chinese Office Action for Application No. 2015105418920 dated May 3, 2018 (14 pages including Statement of Relevance).
First Chinese Office Action for Application No. 201510531561.9 dated Jun. 28, 2018 (12 pages including Statement of Relevance).
International Search Report with Written Opinion for related Application No. PCT/US2018/035652 dated Aug. 31, 2018 (14 pages).
Australian Examination Report for related Application No. 2015210478 dated Sep. 26, 2018 (3 pages).
United States Patent Office Action for U.S. Appl. No. 15/995,998 dated Jun. 1, 2018.
United States Patent Office Action for related U.S. Appl. No. 16/107,688 dated Oct. 4, 2018 (7 pages).
Polish Patent Office Action for Application No. P-413691 dated May 10, 2019.
Jaszczsuk et al., "Integrated System for Control and Visualization of Longwall Machinery", Aachen International Mining Symposia, Jun. 2009.

(56) References Cited

OTHER PUBLICATIONS

Marewski et al. "From Shendong to Bowen Basin—Longwall Shearer for Thick Seam Mining", Aachen International Mining Symposia, Jun. 2009.
CSIRO Exploration and Mining Report, "Interconnection of Landmark Compliant Longwall Mining Equipment—Shearer Communication and Functional Specification for Enhanced Horizon Control", Dec. 2005.
Douglas, Stephen, 2013 LONGWALL US Conference "Application of Shearer Automation" Jun. 2013.
Australian Patent Office Examination Report for related Application No. 2018282356 dated Aug. 1, 2019 (2 pages).

* cited by examiner

HORIZON MONITORING FOR LONGWALL SYSTEM

RELATED APPLICATION

The present application is a continuation of U.S. patent application Ser. No. 16/107,688, published as U.S. Patent Publication No. 2018/0355720, which is a continuation of U.S. patent application Ser. No. 15/651,422, granted as U.S. Pat. No. 10,082,026, which is a continuation of U.S. patent application Ser. No. 14/839,599, granted as U.S. Pat. No. 9,726,017, which claims priority to U.S. Provisional Patent Application No. 62/043,387; and is related to U.S. patent application Ser. No. 14/839,581, granted as U.S. Pat. No. 9,739,148, the entire contents of all of which are incorporated herein by reference.

FIELD OF THE INVENTION

The present invention relates to monitoring pan-line and cut horizon and shearer position of a longwall mining system.

SUMMARY

In one embodiment, the invention provides a method of monitoring a longwall shearing mining machine in a longwall mining system, wherein the shearing mining machine includes a shearer having a first cutter drum and a second cutter drum, the method including receiving, by a processor, horizon profile data over a shear cycle. The horizon profile data includes information regarding at least one of the group comprising of a position of the shearer, a position of the first cutter drum, a position of the second cutter drum, and the pitch and roll angles of the shearer body. The method also includes analyzing the horizon profile data, by the processor, to determine whether a position failure occurred during the shear cycle based on whether the horizon profile data was within normal operational parameters during the shear cycle, and generating an alert upon determining that the position failure occurred during the shear cycle.

In another embodiment the invention provides a monitoring device for a longwall mining system including a shearer having a first cutter drum, a second cutter drum, and a first sensor to determine a position of at least one of the shearer, the first cutter drum, the second cutter drum, and the pitch and roll angles of the shearer body through-out a shear cycle. The monitoring device includes a monitoring module implemented on a processor in communication with the shearer to receive horizon profile data including information regarding at least one of the group comprising of the position of the shearer, the position of the first cutter drum, and the position of the second cutter drum. The monitoring module includes an analysis module configured to analyze the horizon profile data and to determine whether a position failure occurred during the shear cycle based on whether the horizon profile data was within normal operational parameters during the shear cycle; and an alert module configured to generate an alert upon determining that the position failure occurred during the shear cycle.

Other aspects of the invention will become apparent by consideration of the detailed description and accompanying drawings.

DETAILED DESCRIPTION

Figure 1:
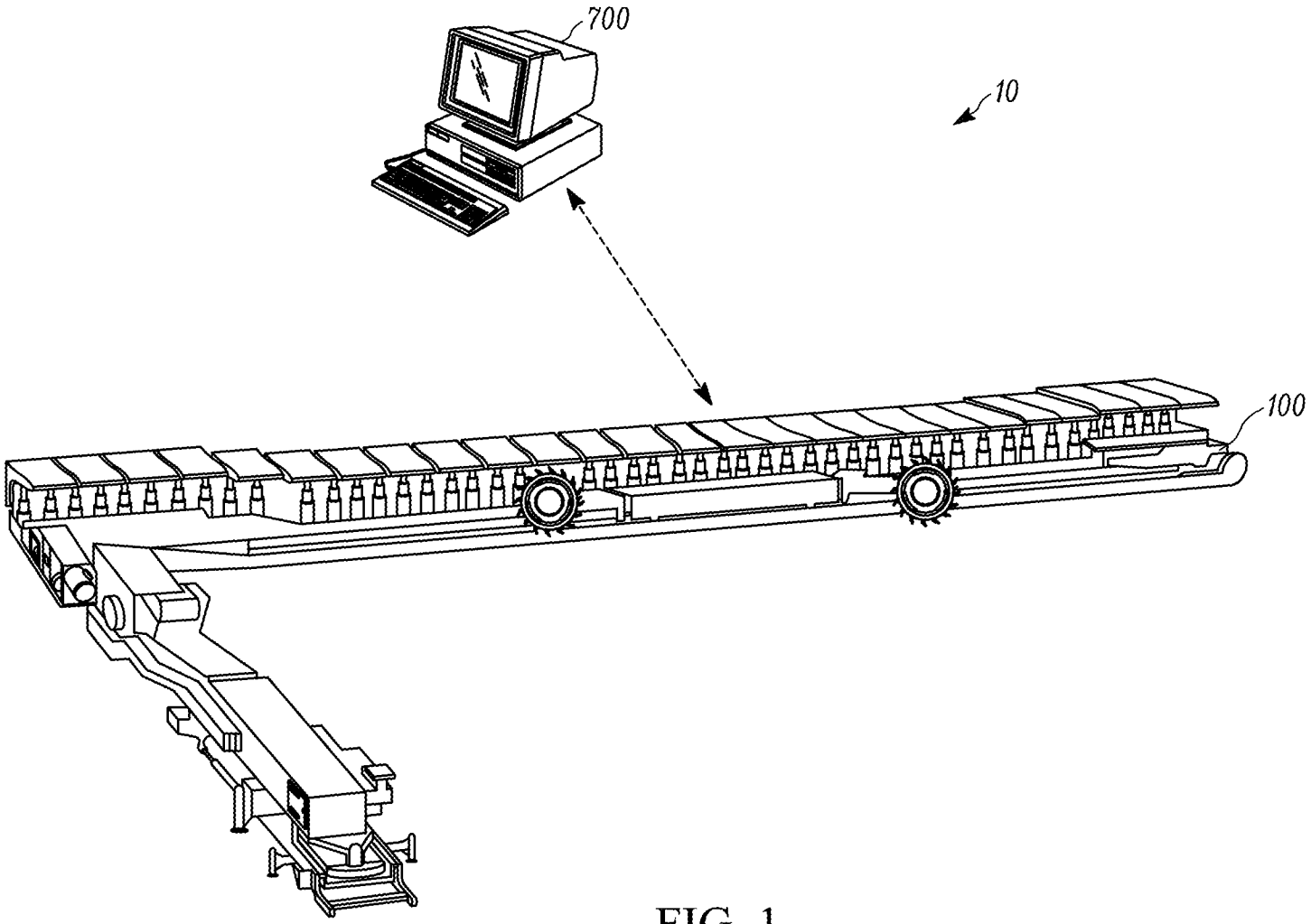
FIG. 1 is a schematic diagram of an extraction system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it would be noted that a plurality of hardware and software based devices, as well as a plurality of different structural components, may be utilized to implement the invention. Furthermore, and as described in subsequent paragraphs, the specific mechanical configurations illustrated in the drawings are intended to exemplify embodiments of the invention. However, other alternative mechanical configurations are possible. For example, "controllers" and "modules" described in the specification can include standard processing components, such as one or more processors, one or more computer-readable medium modules, one or more input/output interfaces, and various connections (e.g., a system bus) connecting the components. In some instances, the controllers and modules may be implemented as one or more of general purpose processors, digital signal processors DSPs), application specific integrated circuits (ASICs), and field programmable gate arrays (FPGAs) that execute instructions or otherwise implement their functions described herein.

FIG. 1 illustrates an extraction system 10. The extraction system 10 includes a longwall mining system 100 and a health monitoring system 700. The extraction system 10 is configured to extract a product, for example, coal from a mine in an efficient manner. The longwall mining system 100 physically extracts coal from an underground mine, while the health monitoring system 700 monitors operation of the longwall mining system 100 to ensure that extraction of coal remains efficient.

Longwall mining begins with identifying a coal seam to be mined, then "blocking out" the seam into coal panels by excavating roadways around the perimeter of each panel. During excavation of the seam (i.e., extraction of coal), select pillars of coal can be left unexcavated between adjacent coal panels to assist in supporting the overlying geological strata. The coal panels are excavated by the longwall mining system 100, which includes components such as automated electro-hydraulic roof supports, a coal shearing machine (i.e., a longwall shearer), and an armored face conveyor (i.e., AFC) parallel to the coal face. As the shearer travels the width of the coal face, removing a layer of coal (e.g., a web of coal), the roof supports automatically advance to support the roof of the newly exposed section of strata. The AFC is then advanced by the roof supports toward the coal face by a distance equal to the depth of the coal layer previously removed by the shearer. Advancing the AFC toward the coal face in such a manner allows the shearer to engage with the coal face and continue shearing coal away from the coal face.

The health monitoring system 700 monitors shearer position data of the longwall mining system 100 to ensure that the longwall mining system 100 does not experience a loss of horizon. Controlling the horizon in a longwall mining system allows a more efficient extraction of coal by extracting a maximum amount of coal without weakening support for overlying geological strata. For example, loss of horizon in the longwall mining system 100 can cause a degradation of coal quality (e.g., when other non-coal material is being extracted along with coal), deterioration of face alignment, formation of cavities by compromising overlying seam strata, and in some instances, loss of horizon may cause damage to the longwall mining system 100 (e.g., if a roof support canopy collides with a shearer). In some embodiments, the health monitoring system 700 monitors roof support data, AFC data, and other longwall mining system data, additionally or alternatively to the shearer position data.

Figure 2A:
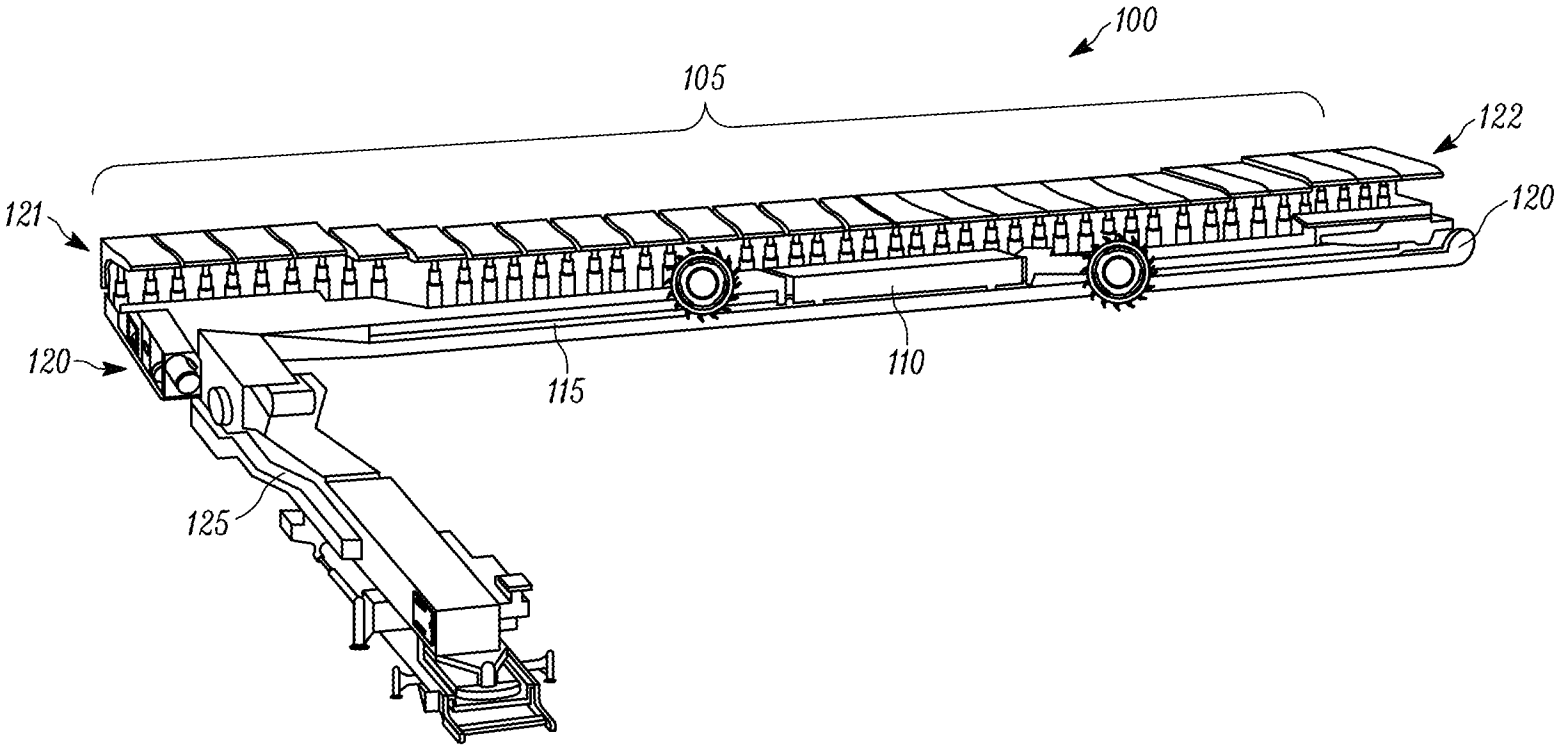
FIGS. 2A-B illustrate a longwall mining system of the extraction system of FIG. 1.

FIG. 2A illustrates the longwall mining system 100 including roof supports 105 and a longwall shearer 110. The roof supports 105 are interconnected parallel to the coal face (not shown) by electrical and hydraulic connections. Further, the roof supports 105 shield the shearer 110 from the overlying geological strata. The number of roof supports 105 used in the mining system 100 depends on the width of the coal face being mined since the roof supports 105 are intended to protect the full width of the coal face from the strata. The shearer 110 is propagated along the line of the coal face by an armored face conveyor (AFC) 115, which has a dedicated rack bar for the shearer 110 running parallel to the coal face between the face itself and the roof supports 105. The AFC 115 also includes a conveyor parallel to the shearer rack bar, such that excavated coal can fall onto the conveyor to be transported away from the face. The conveyor and rack bar of the AFC 115 are driven by AFC drives 120 located at a maingate 121 and a tailgate 122, which are at distal ends of the AFC 115. The AFC drives 120 allow the conveyor to continuously transport coal toward the maingate 121 (left side of FIG. 2A), and allows the shearer 110 to be hauled along the rack bar of the AFC 115 bi-directionally across the coal face. Note that depending on the specific mine layout, the layout of the longwall mining system 100 can be different than described above, for example, the maingate can be on the right distal end of the AFC 115 and the tailgate can be on the left distal end of the AFC 115.

Figure 2B:
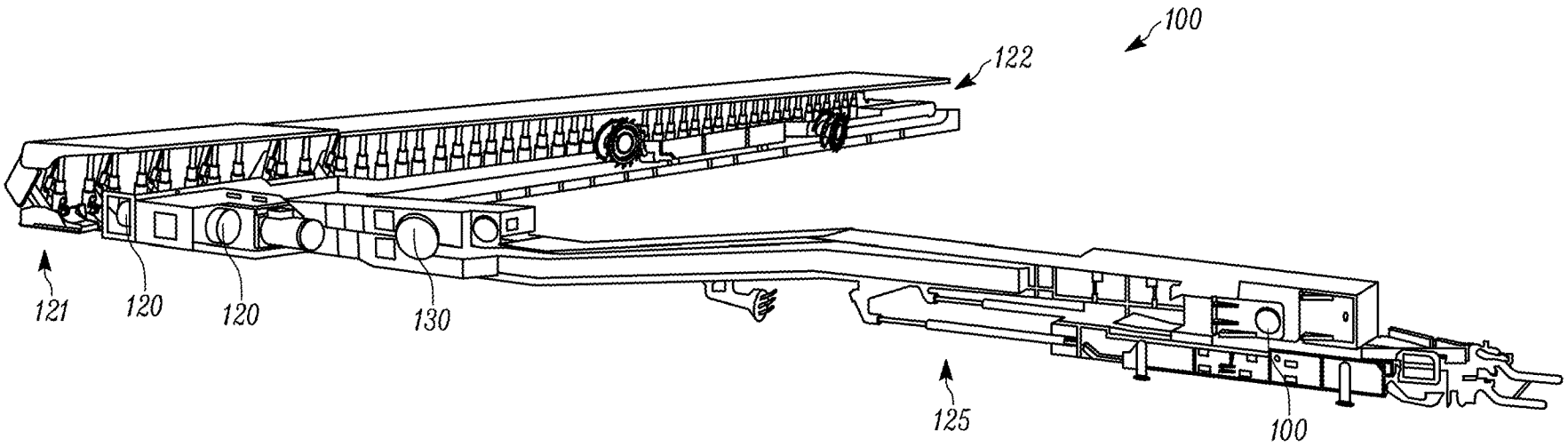

The system 100 also includes a beam stage loader (BSL) 125 arranged perpendicularly at the maingate end of the AFC 115. FIG. 2B illustrates a perspective view of the system 100 and an expanded view of the BSL 125. When the won coal hauled by the AFC 115 reaches the maingate 121, it is routed through a 90° turn onto the BSL 125. In some instances, the BSL 125 interfaces with the AFC 115 at an oblique angle (e.g., a non-right angle). The BSL 125 then prepares and loads the coal onto a maingate conveyor (not shown), which transports the coal to the surface. The coal is prepared to be loaded by a crusher (or sizer) 130, which breaks down the coal to improve loading onto the maingate conveyor. Similar to the conveyor of the AFC 115, the BSL's 125 conveyor is driven by a BSL drive.

Figure 3A:
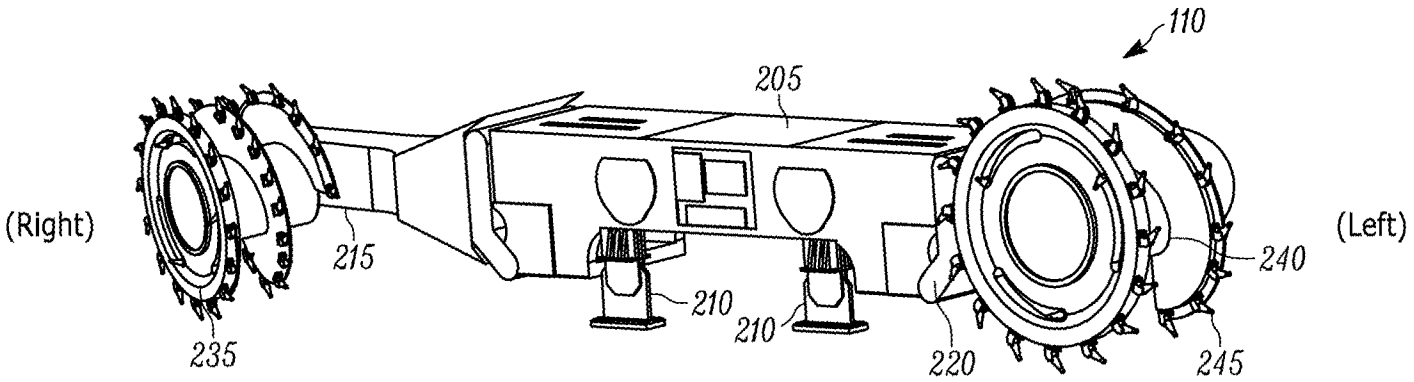
FIGS. 3A-C illustrate a longwall shearer of the longwall mining system.
Figure 3B:
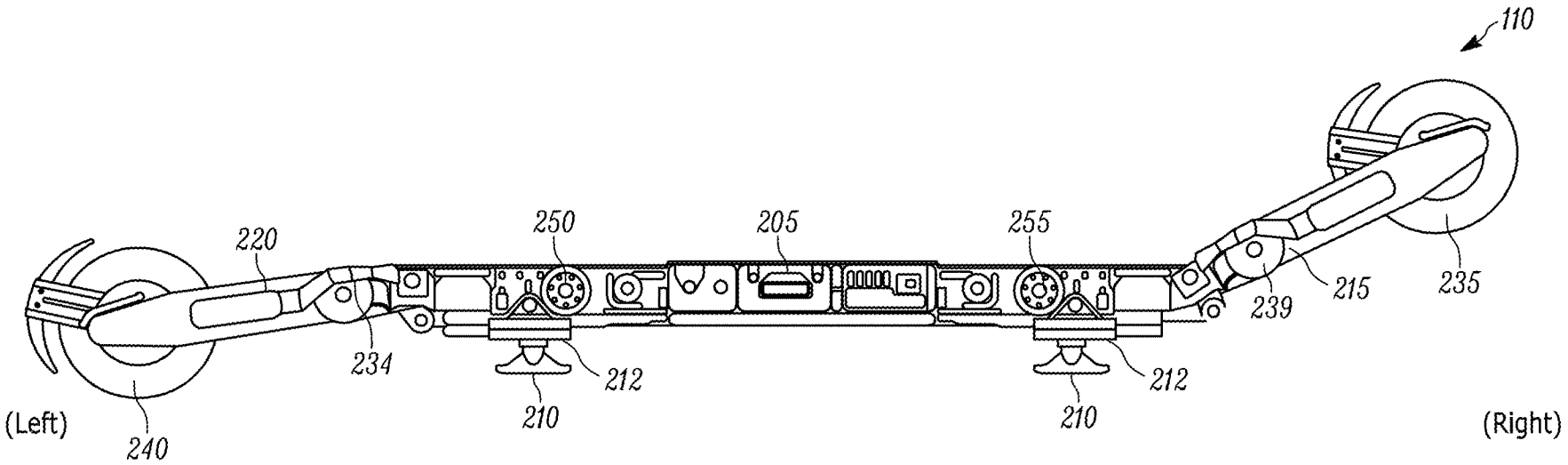
Figure 3C:
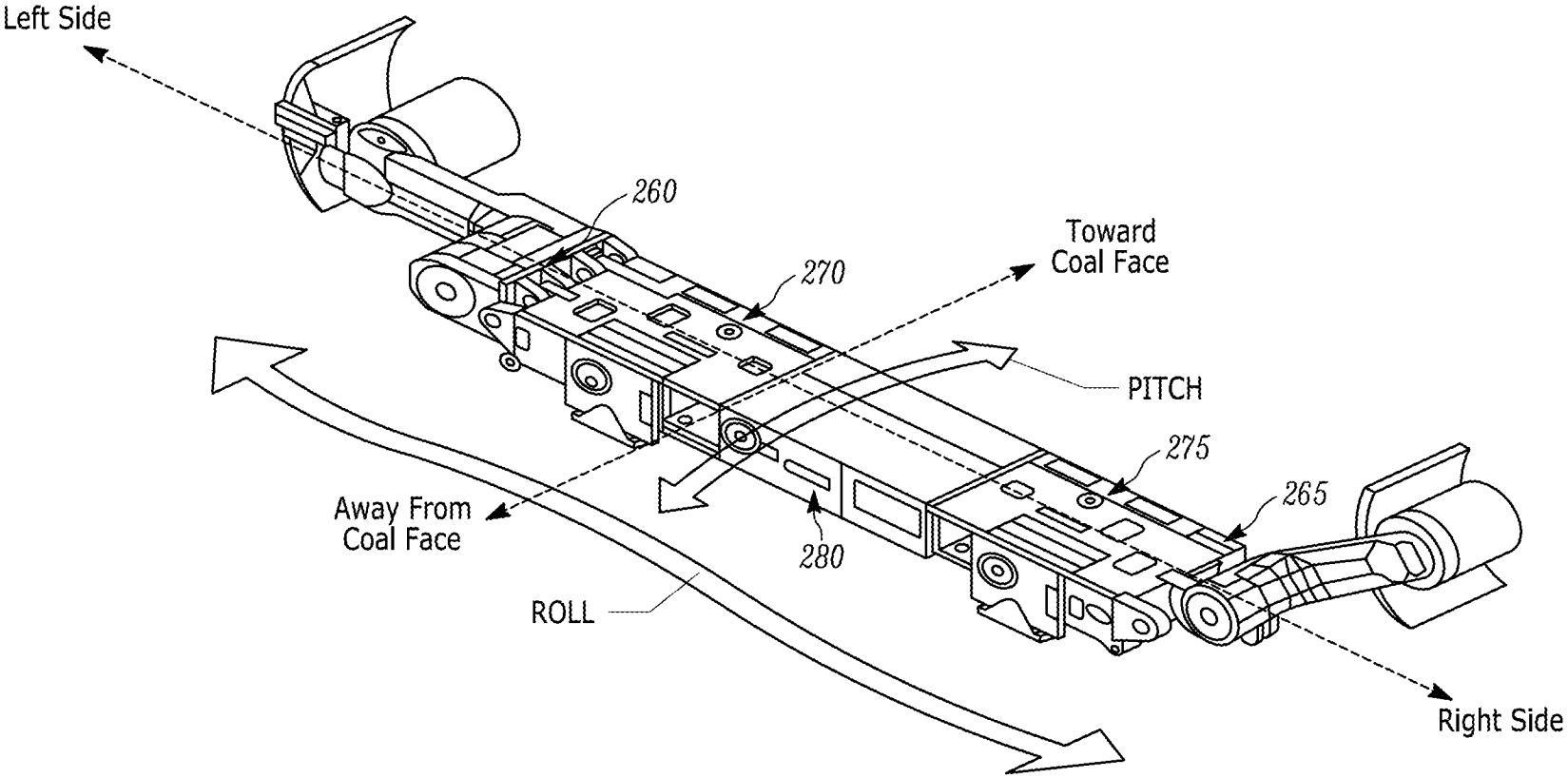

FIGS. 3A-C illustrate the shearer 110. FIG. 3A illustrates a perspective view of the shearer 110. The shearer 110 has an elongated central housing 205 that stores the operating controls for the shearer 110. Extending below the housing 205 are skid shoes 210 (FIG. 3A) and trapping shoes 212 (FIG. 3B). The skid shoes 210 support the shearer 110 on the face side of the AFC 115 (e.g., the side nearest to the coal face) and the trapping shoes 212 support the shearer 110 on the goaf side of the AFC 115. In particular, the trapping shoes 212 and haulage sprockets engage the rack bar of the AFC 115 allowing the shearer 110 to be propelled along the AFC 115 and coal face. Extending laterally from the housing 205 are left and right ranging arms 215 and 220, respectively, which are raised and lowered by hydraulic cylinders attached to the under-side of the ranging arms 215, 220 and shearer body 205. On the distal end of the right ranging arm 215 (with respect to the housing 205) is a right cutter drum 235, and on the distal end of the left ranging arm 220 is a left cutter drum 240. Each cutter drum 235, 240 is driven by an electric motor 234, 239 via the gear train within the ranging arm 215, 220. Each of the cutter drums 235,240 has a plurality of mining bits 245 (e.g., cutting picks) that abrade the coal face as the cutter drums 235,240 are rotated, thereby cutting away the coal. The mining bits 245 are also accompanied by spray nozzles that spray fluid during the mining process in order to disperse noxious and/or combustible gases that develop at the excavation site, suppress dust, and enhance cooling. FIG. 3B illustrates a side view of the shearer 110 including the cutter drums 235,240; ranging arms 215,220; trapping shoes 212, and housing 205. FIG. 3B also shows detail of a left haulage motor 250 and right haulage motor 255

The shearer 110 also includes various sensors, to enable automatic control of the shearer 110. For example, the shearer 110 includes a left ranging arm inclinometer 260, a right ranging arm inclinometer 265, left haulage gear sensors 270, right haulage gear sensors 275, and a pitch angle and roll angle sensor 280. FIG. 3C shows the approximate locations of the various sensors. It should be understood that the sensors may be positioned elsewhere in the shearer 110. The inclinometers 260, 265 provide information regarding an angle of slope of the ranging arms 215, 220. Ranging arm position could also be measured with linear transducers mounted between each ranging arm 215, 220 and the shearer body 205. The haulage gear sensors 270, 275 provide information regarding the position of the shearer 110 along the AFC 115 as well as speed and direction of movement of the shearer 110. The pitch and roll angle sensor 280 provides information regarding the angular alignment of the shearer body 205. As shown in FIG. 3C, the pitch of the shearer 110 refers to an angular tilting toward and away from the coal face, while the roll of the shearer 110 refers to an angular difference between the right side of the shearer 110 and the left side of the shearer 110, as more clearly shown by the axes in FIG. 3C. Both the pitch and the roll of the shearer 110 are measured in degrees. Positive pitch refers to the shearer 110 tilting away from the coal face (i.e., face side of the shearer 110 is higher than the goaf side of the shearer 110), while negative pitch refers to the shearer 110 tilting toward the coal face (i.e., face side of the shearer 110 is lower than the goaf side of the shearer 110). Positive roll refers to the shearer 110 tilting so that the right side of the shearer 110 is higher than the left side of the shearer 110, while negative roll refers to the shearer 110 tilting so that the right side is lower than the left side of the shearer 110. The sensors provide information to determine a relative position of the shearer 110, the right cutter drum 235, and the left cutter drum 240.

Figure 4:
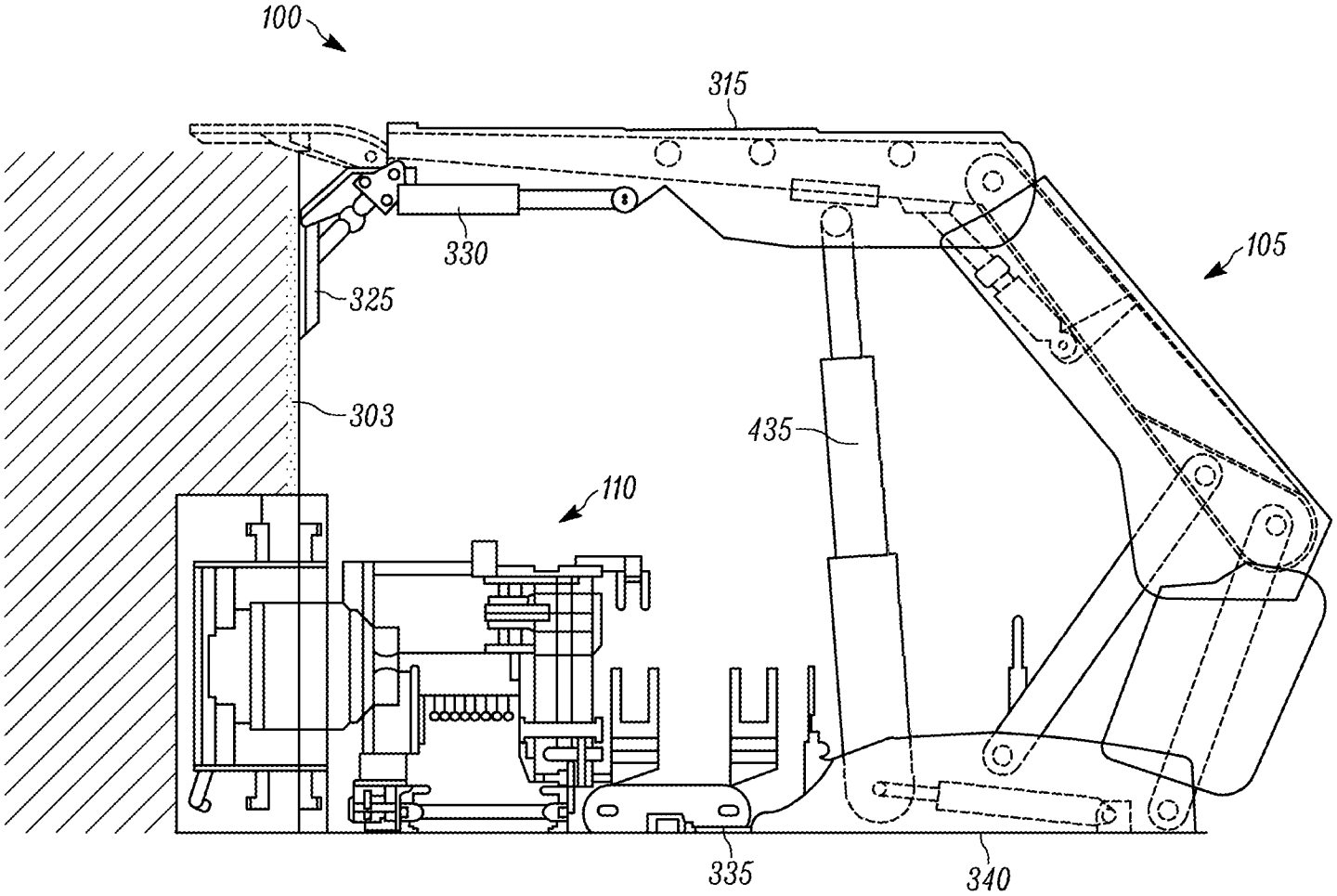
FIG. 4 illustrates a powered roof support of the longwall mining system.
Figure 5:
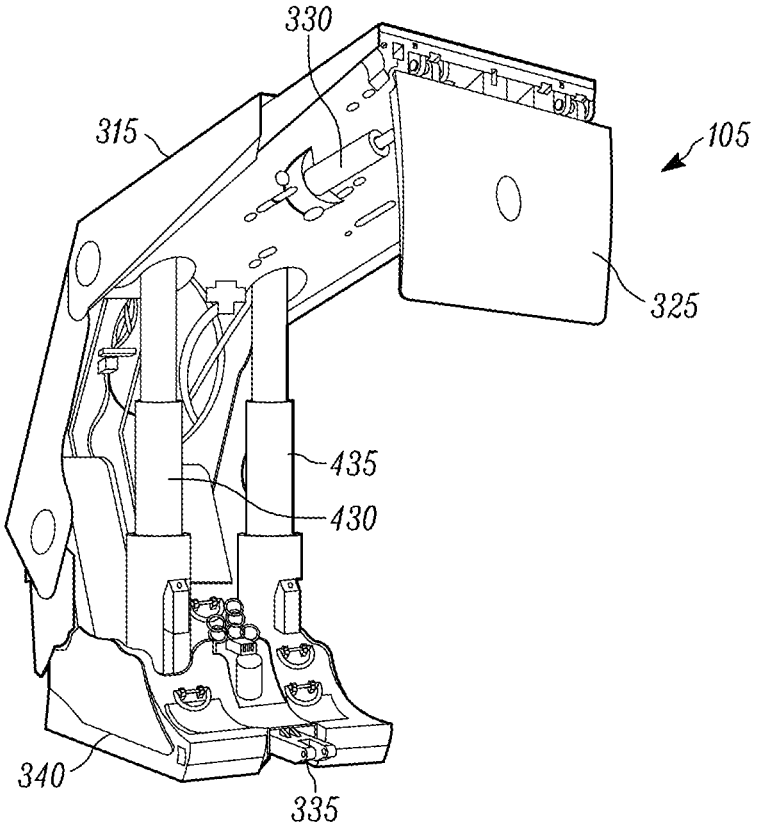
FIG. 5 illustrates a profile view of the roof support of the longwall mining system.

FIG. 4 illustrates the longwall mining system 100 as viewed along the line of a coal face 303. The roof support 105 is shown shielding the shearer 110 from the strata above by an overhanging canopy 315 of the roof support 105. The canopy 315 is vertically displaced (i.e., moved toward and away from the strata) by hydraulic legs 430, 435 (see FIG. 5). The left and right hydraulic legs 430, 435 contain pressurized fluid to support the canopy 315. The canopy 315 thereby exerts a range of upward forces on the geological strata by applying different pressures to the hydraulic legs 320. Mounted to the face end of the canopy 315 is a deflector or sprag 325 which is shown in a face-supporting position. However, the sprag 325 can also be fully extended, as shown in ghost, by a sprag ram 330. An advance ram 335 attached to a base 340 allows the roof support 105 to be advanced toward the coal face 303 as the layers of coal are sheared away to support the newly exposed strata. The advance ram 335 also allows the roof support 105 to push the AFC 115 forward.

Figure 6A:
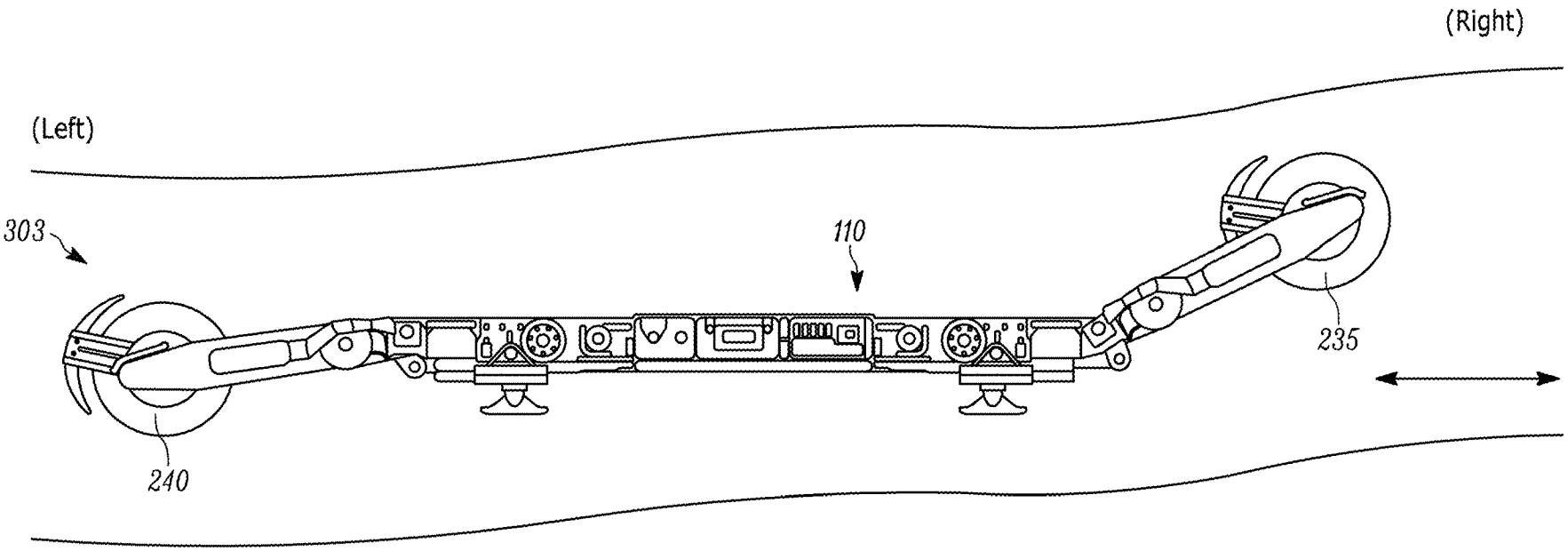
FIGS. 6A-B illustrate a longwall shearer as it passes through a coal seam.
Figure 6B:
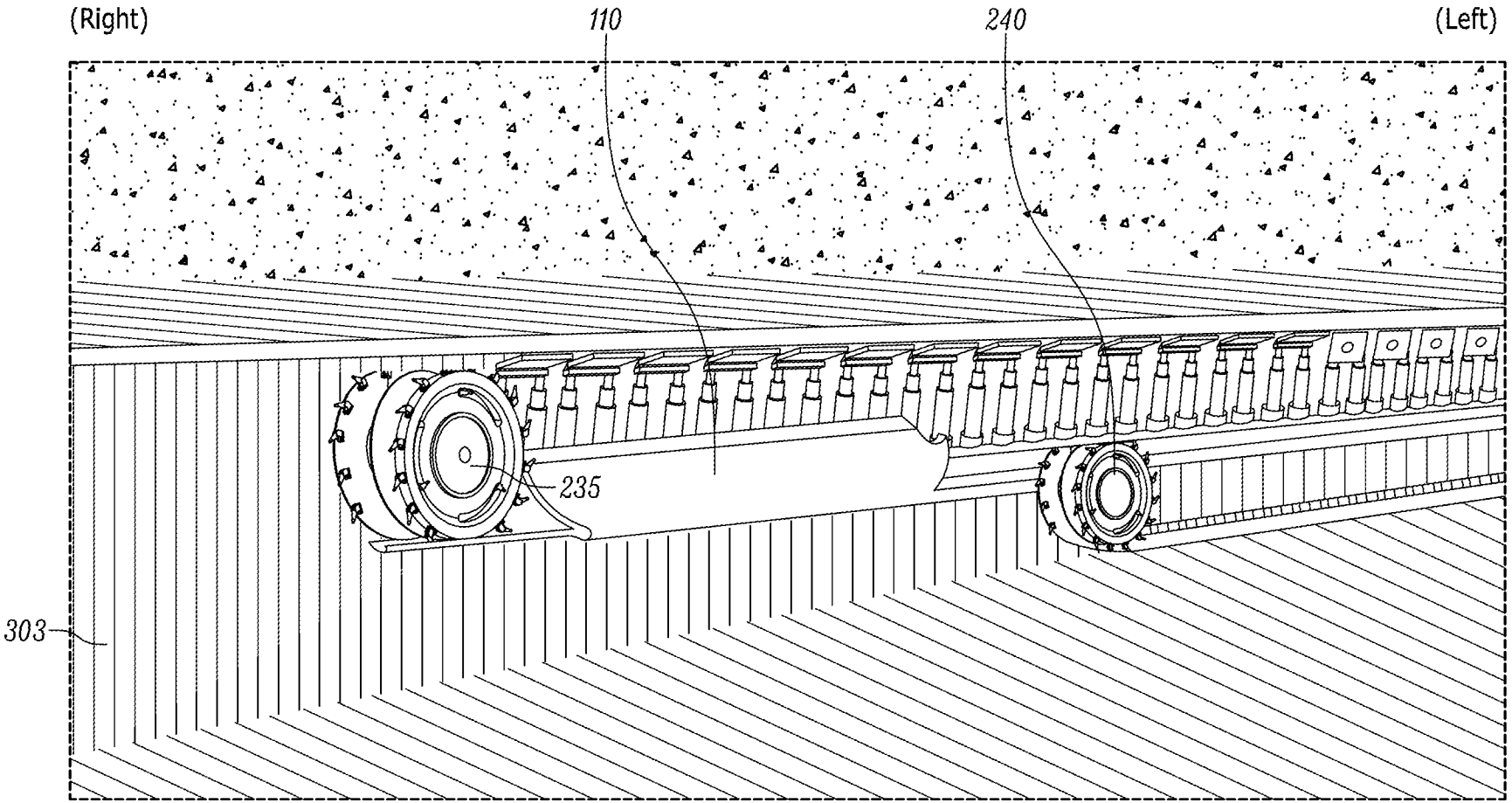

FIG. 6A illustrates the longwall shearer 110 as it passes along the width of a coal face 303. As shown in FIG. 6A, the shearer 110 can displace laterally along the coal face 303 in a bi-directional manner, though it is not necessary that the shearer 110 cut coal bi-directionally. For example, in some mining operations, the shearer 110 is capable of being propelled bi-directionally along the coal face 505, but only shears coal when traveling in one direction. For example, the shearer 110 may be operated to extract one web of coal over the course of a first, forward pass over the width of the coal face 303, but not extract another web of coal on its returning pass. Alternatively, the shearer 110 can be configured to extract one web of coal during each of the forward and return passes, thereby performing a bi-directional cutting operation. FIG. 6B illustrates the longwall shearer 110 as it passes over the coal face 303 from a face-end view. As shown in FIG. 6B, the left cutter 240 and the right cutter 235 of the shearer 110 are staggered to accommodate the full height of the coal seam being mined. In particular, as the shearer 110 displaces horizontally along the AFC 115, the left cutter 240 is shown shearing coal away from the bottom half of the coal face 303, while the right cutter 235 is shown shearing coal away from the top half of the coal face 303.

Figure 7:
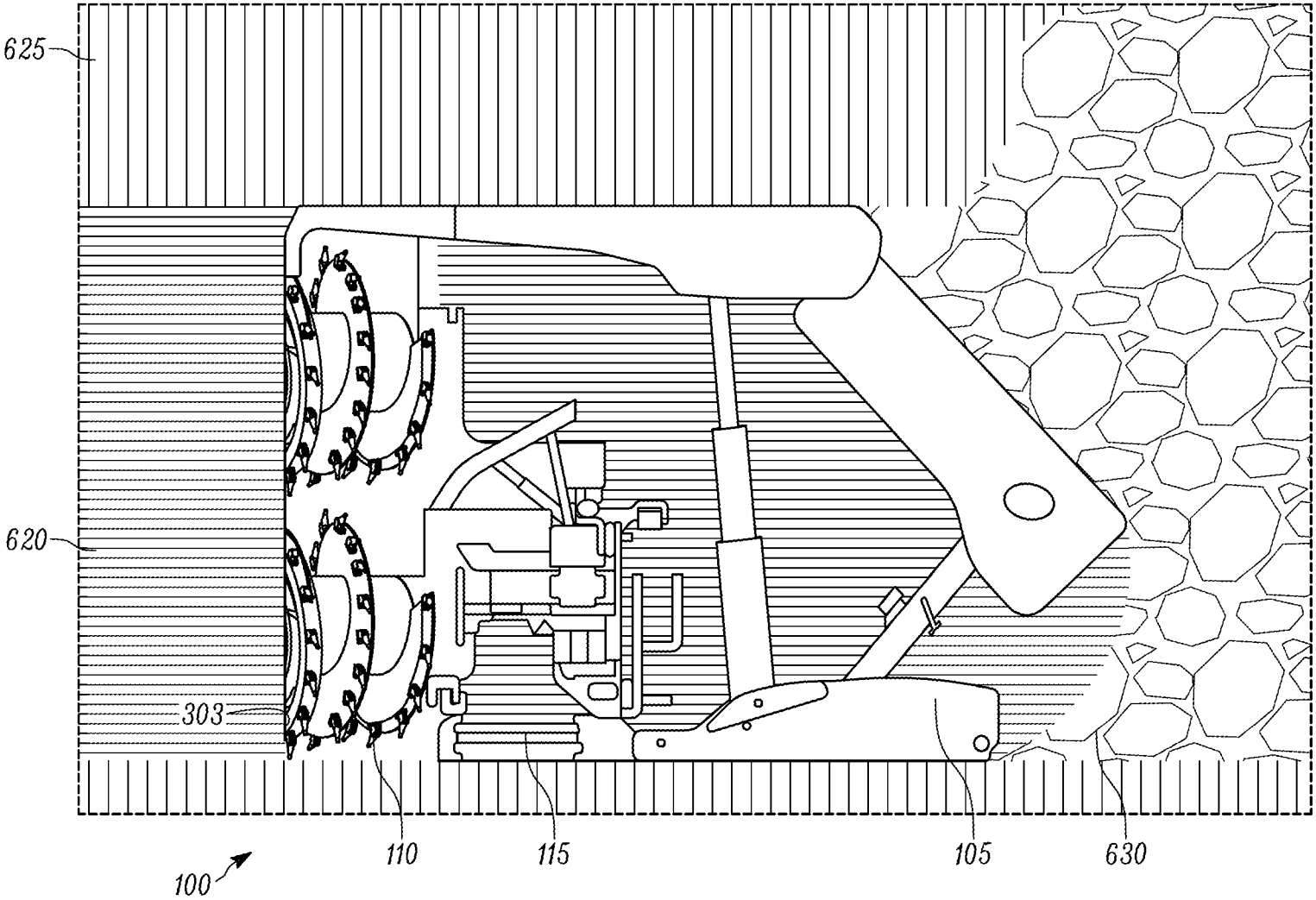
FIG. 7 illustrates collapsing of the geological strata as coal is removed from the coal seam.

As coal is sheared away from the coal face 303, the geological strata overlying the excavated regions are allowed to collapse behind the mining system 100 as the mining system 100 advances through the coal seam. FIG. 7 illustrates the mining system 100 advancing through a coal seam 620 as the shearer 110 removes coal from the coal face 303. In particular, the coal face 303 as illustrated in FIG. 7 extends perpendicularly from the plane of the figure. As the mining system 100 advances through the coal seam 620 (to the right, in FIG. 7), the strata 625 is allowed to collapse behind the system 100, forming a goaf 630. Under certain conditions, collapse of the overlying strata 625 can also form cavities, or unequal distributions of strata, above the roof support 105. Cavity formation above the roof support 105 can cause unevenly-distributed pressure over the canopy 315 of the roof support 105 by the overlying strata, which can cause damage to the mining system 100 and, in particular, the roof support 105. A cavity may extend forward into the area still to be mined, causing disruption to the longwall mining process, reducing production rates, and may result in equipment damage and increased wear rates.

Cavity formation can be caused by a loss of horizon. The loss of horizon refers to an instance in which alignment and/or position of the longwall mining system 100, including the shearer 110, AFC 115, and the roof support 105, deviates significantly from the true topography of the coal seam (e.g., when the left and right cutter drums 240, 235 cut outside the coal seam roof and floor boundaries). When this occurs the mining system 100 does not extract coal in an efficient manner. For example, the shearer 110 may not be properly aligned with the coal seam and therefore, extract non-coal material causing the quality of coal to degrade. Loss of horizon can also introduce unnecessary articulation in the AFC 115 and roof supports 105, which may result in equipment damage and increased wear, and may restrict the roof supports 105 from providing sufficient strata control. The health monitoring system 700 receives information from the various sensors 260, 265, 270, 275, 280 included in the shearer 110 to monitor the alignment and position of the shearer 110 and the cutter drums 235, 240. The health monitoring system 700 generates a pan-line, a floor cut, and a roof cut profile including information regarding the angular position (i.e., pitch and roll) of the shearer 110, which is then used to predict a possible loss of horizon and generates alerts when a possible loss of horizon is predicted.

Figure 8:
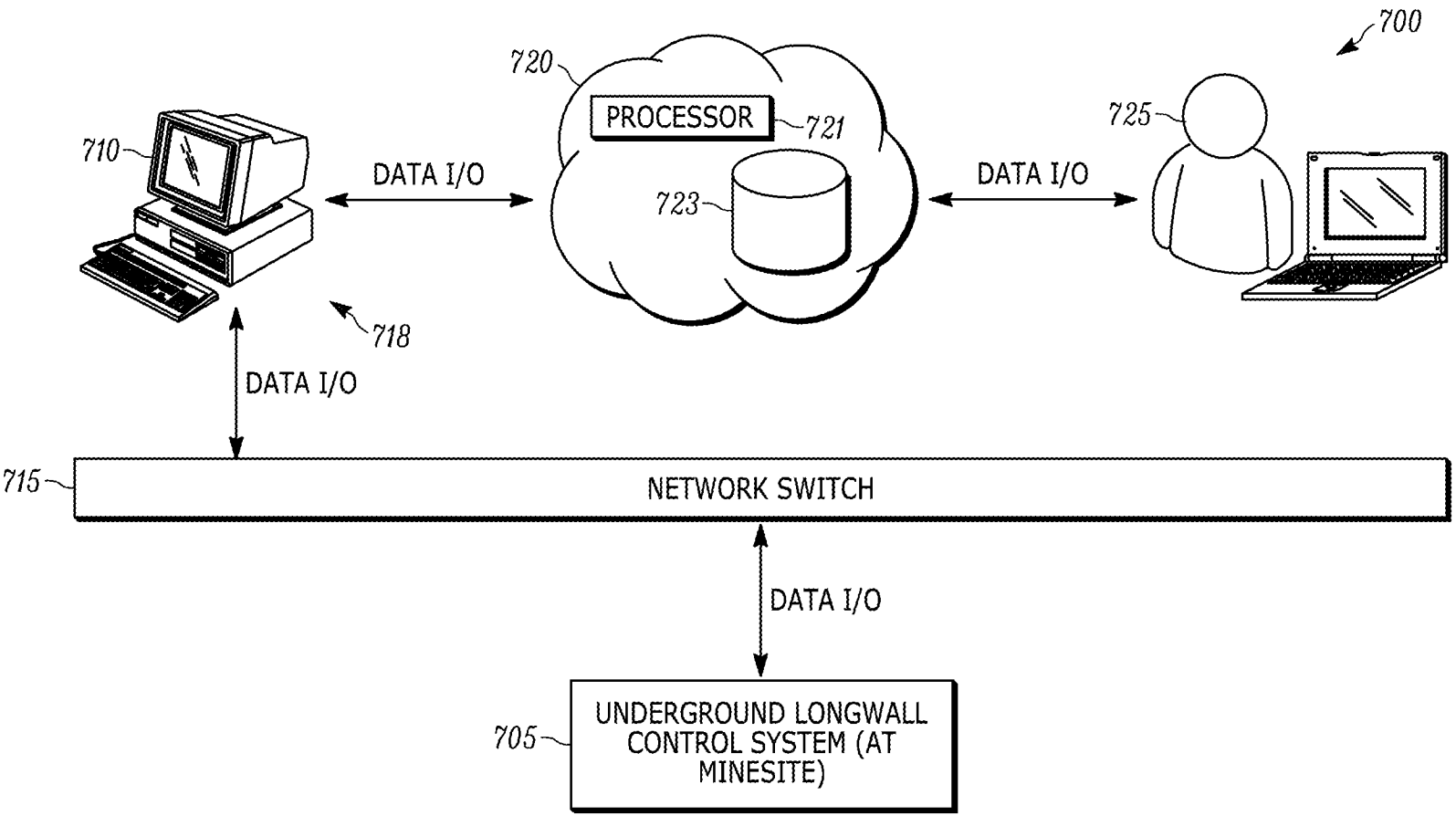
FIG. 8 is a schematic diagram of a longwall health monitoring system according to one embodiment of the invention.

FIG. 8 illustrates the health monitoring system 700 that can be used to detect and respond to issues arising in various underground longwall control systems 705. The longwall control systems 705 are located at the mining site, and include various components and controls of the shearer 110. In some embodiments, the control systems 705 also include various components and controls of the roof supports 105, the AFC 115, and the like. The longwall control systems 705 are in communication with a surface computer 710 via a network switch 715 and an Ethernet or similar network 718, both of which can also be located at the mine site. Data from the longwall control systems 705 is communicated to the surface computer 710 via the network switch 715 and Ethernet or similar network 718, such that, for example, the network switch 715 receives and routes data from the individual control systems of the shearer 110. The surface computer 710 is further in communication with a remote monitoring system 720, which can include various computing devices and processors 721 for processing data received from the surface computer 710 (such as the data communicated between the surface computer 710 and the various longwall control systems 705), as well as various servers 723 or databases for storing such data. The remote monitoring system 720 processes and archives the data from the surface computer 710 based on control logic that can be executed by one or more computing devices or processors of the remote monitoring system 720. The particular control logic executed at the remote monitoring system 720 can include various methods for processing data from each mining system component (i.e., the roof supports 105, AFC 115, shearer 110, etc.).

Thus, outputs of the remote monitoring system 720 can include alerts (events) or other warnings pertinent to specific components of the longwall mining system 100, based on the control logic executed by the system 720. These warnings can be sent to designated participants (e.g., via email, SMS messaging, internet, or intranet based dashboard interface, etc.), such as service personnel at a service center 725 with which the monitoring system 720 is in communication, and personnel underground or above ground at the mine site of the underground longwall control systems 705. It should be noted that the remote monitoring system 720 can also output, based on the control logic executed, information that can be used to compile reports on the mining procedure and the health of involved equipment. Accordingly, some outputs may be communicated with the service center 725, while others may be archived in the monitoring system 720 or communicated with the surface computer 710.

Each of the components in the health monitoring system 700 is communicatively coupled for bi-directional communication. The communication paths between any two components of the system 700 may be wired (e.g., via Ethernet cables or otherwise), wireless (e.g., via a WiFi®, cellular, Bluetooth® protocols), or a combination thereof. Although only an underground longwall mining system and a single network switch is depicted in FIG. 8, additional mining machines both underground and surface-related (and alternative to longwall mining) may be coupled to the surface computer 710 via the network switch 715. Similarly, additional network switches 715 or connections may be included to provide alternate communication paths between the underground longwall control systems 705 and the surface computer 710, as well as other systems. Furthermore, additional surface computers 710, remote monitoring systems 720, and service centers 725 may also be included in the system 700.

Figure 9:
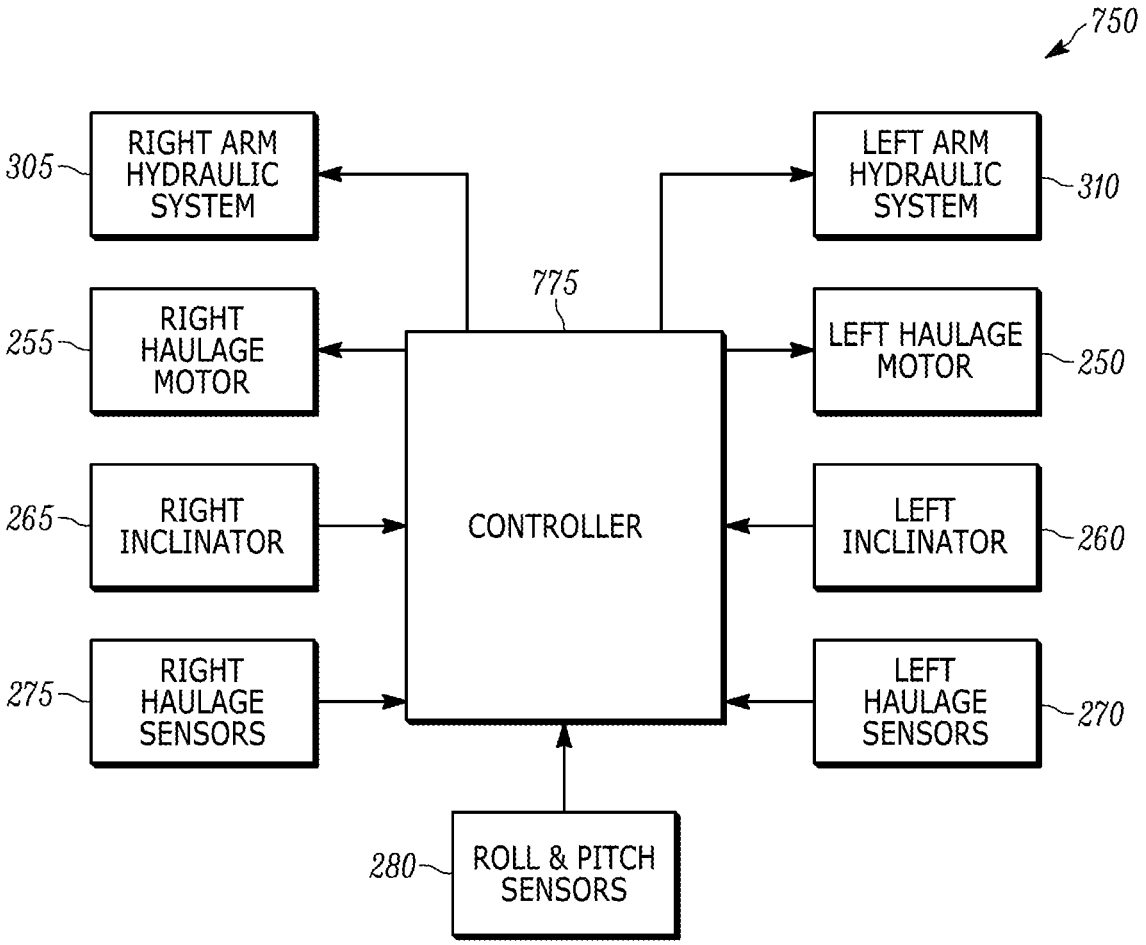
FIG. 9 is a schematic diagram of a horizon control system according to the system of FIG. 8.

FIG. 9 illustrates a block diagram example of the underground longwall control systems 705. In particular, FIG. 9 illustrates a shearer control system 750 for the shearer 110. The shearer control system 750 includes a main controller 775 that communicates with the various sensors 260, 265, 270, 275, 280 of the shearer 110, a right arm hydraulic system 305, a left arm hydraulic system 310, the right haulage motor 255, the left haulage motor 250, and the electric motors 234, 239 for the ranging arms 215, 220. The haulage motors 250, 255 advance the shearer 110 along the AFC rack bar. The hydraulic systems 305, 310 control vertical movement (i.e., up and down) of the right ranging arm 215 and the left ranging arm 220, respectively. The electric motors 234, 239 for the ranging arms 215, 220 rotate the right cutter drum 235 and the left cutter drum 240, respectively. The controller 775 receives signals from the various sensors 260, 265, 270, 275, 280 as well as inputs from an operator radio of the shearer 110. The sensors 260, 265, 270, 275, 280 provide feedback on the position and movement of the shearer 110 and its components to the controller 775 and the controller 775 controls the hydraulic systems 305, 310, and the motors 250, 255 based on the output from the sensors 260, 265, 270, 275, 280. The controller 775 includes hardware (e.g., a processor) and software to control the hydraulic systems 305, 310 and the motors 250, 255 based on locally-stored instructions/logic, based on instructions from the operator's radio, and/or based on instructions communicated from a different processor of the health monitoring system 700, or based on a combination thereof.

The controller 775 can aggregate the shearer position data (e.g., the data collected by the sensors 260, 265, 270, 275, 280) and store the aggregated data in a memory, including a memory dedicated to the controller 775. Periodically, the aggregated data is output as a data file via the network switch 715 to the surface computer 710. From the surface computer 710, the data is communicated to the remote monitoring system 720, where the data is processed and stored according to control logic particular for analyzing data from the shearer control system 750. Generally, the shearer position data file includes the sensor data aggregated since the previous data file was sent. The aggregated shearer position data is also time-stamped based on the time that the sensors 260, 265, 270, 275, 280 obtained the data. The shearer position data can then be organized based on the time it was obtained. For example, a new data file with sensor data may be sent every five minutes, the data file including sensor data aggregated over the previous five minute window. In some embodiments, the time window for aggregating data can correspond to the time required to complete one shear cycle (e.g., time required to extract one web of coal). In some embodiments, the controller 775 does not aggregate sensor data and the remote monitoring system 720 is configured to aggregate the data as it is received in real-time (streamed) from the controller 775. In other words, the remote monitoring system 720 streams and aggregates the data from the controller 775. The remote monitoring system 720 can also be configured to store the aggregated sensor data. The remote monitoring system 720 can then analyze the shearer position data based on stored aggregated data, or based on shearer position data received in real-time from the controller 775.

In the illustrated embodiment, the remote monitoring system 720 analyzes the shearer position data both on a per shear cycle basis and on an instantaneous basis. When the remote monitoring system 720 analyzes the shearer position data on a shear cycle basis, the processor 721 first identifies shearer position data corresponding to a shear cycle, computes horizon profile data based on the raw shearer position data, and then applies specific rules to the horizon profile data within the shear cycle. When the remote monitoring system 720 analyzes the shearer position data on an instantaneous basis, the processor 721 analyzes the shearer position data on an on-going basis by comparing the shearer position data to predetermined operating parameters. This continuous analysis generally does not require first identifying shearer position data corresponding to the same shear cycle. In some embodiments, the analysis of the shearer position data can be implemented locally at the mine site (e.g., on the controller 775).

Figure 10:
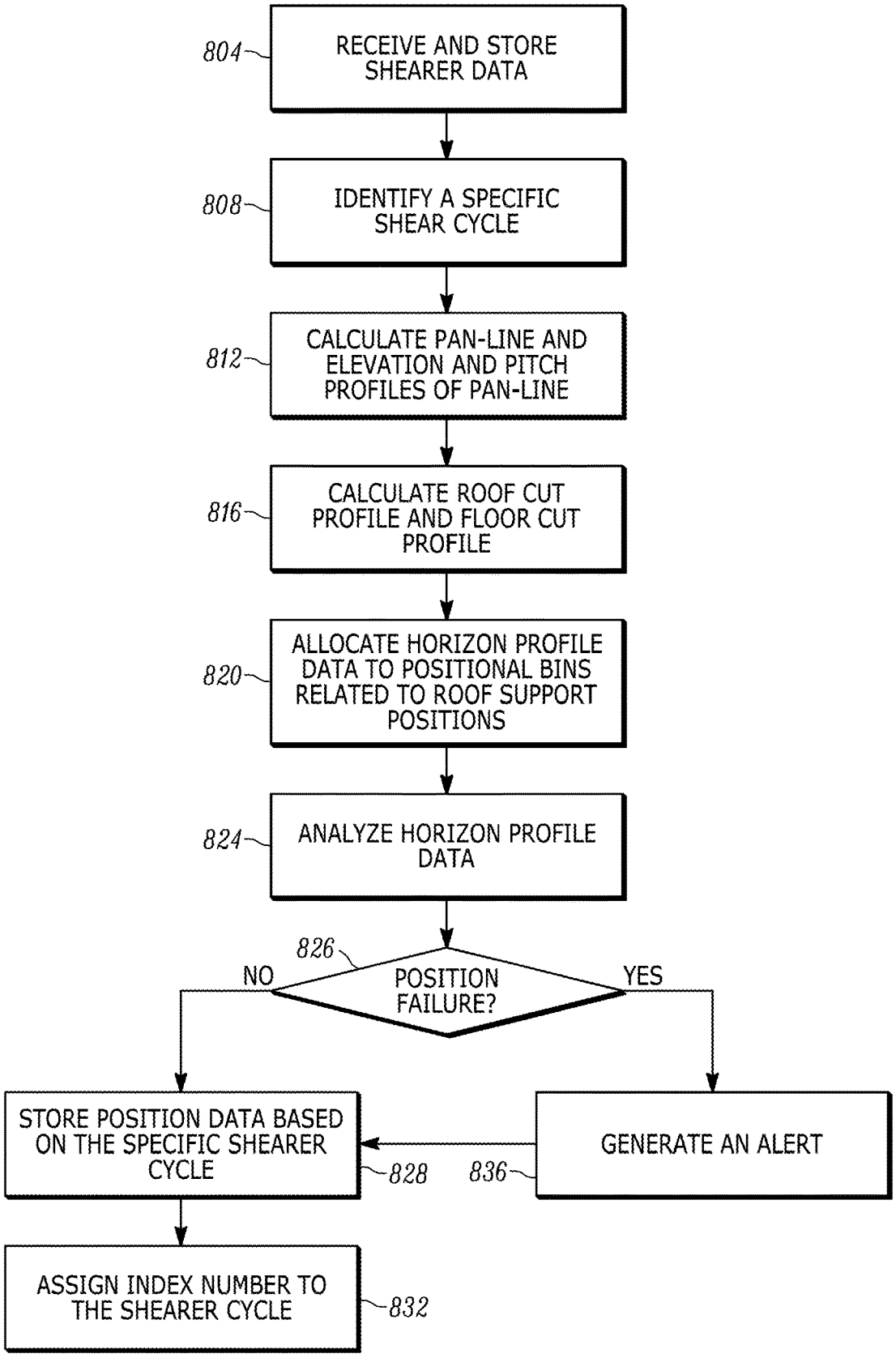
FIG. 10 is a flowchart illustrating a method of monitoring horizon data according to the control system of FIG. 9.

FIG. 10 is a flowchart that illustrates an exemplary method of monitoring the horizon profile data by the remote monitoring system 720. At step 804, the remote monitoring system 720 aggregates and stores shearer position data obtained from the sensors 260, 265, 270, 275, 280. The remote monitoring system 720, and in particular, the processor 721, then identifies a distinct shear cycle encompassing one web of coal from the aggregated data at step 808. Once the shear cycle (e.g., a start and end point of the shear cycle) has been identified by the processor 721, the processor 721 generates the shearer path including an elevation profile and pitch profile using data from the haulage sensors 270, 275, and the pitch angle and roll angle sensor 280 at step 812. The shearer path is referred to as the pan-line. At step 816, the processor 721 calculates a floor cut profile and roof cut profile relative to the pan-line using position data associated with the right cutter drum 235, position data associated with the left cutter drum 240, and shearer specific geometry parameters known or provided by the shearer control system 750. At step 820, the processor 721 allocates horizon profile data (e.g., the elevation profile, pan-line profile, pitch profile, roll rate profile, floor cut profile, and roof cut profile) into positional bins determined based on a roof support index number. Since the roof supports 105 extend the width of the coal face 303, each roof support 105 corresponds to a specific location/position along the coal face 303. For example, the first roof support 105 closest to the maingate can be assigned index number 0, while the last roof support 105 closest to the tailgate can be assigned index number 150. Allocating the position data from the shearer 110 and the cutters 235, 240 to positional bins allows the position data of the shearer 110 and the cutters 235, 240 to be associated with a position along the coal face 303 rather than the time the data was obtained.

At step 824, the processor 721 analyzes the horizon profile data to determine whether the pan-line profile, the floor cut profile, and the roof cut profile are within normal operational ranges. Normal operational ranges can refer to, for example, a maximum or minimum pitch angle for the shearer 110, a maximum or minimum height for the floor cut profile, a maximum or minimum height for the roof cut profile, a maximum or minimum extraction (difference between floor and roof cut profiles), a maximum or minimum roll angle for the shearer 110, and the like. At step 826, the processor 721 determines if a position failure has occurred due to the shearer 110, the right cutter drum 235, or the left cutter drum 240 operating outside of the normal operational ranges. For example, a failure occurs when the relative floor cut profile is below a minimum height. If the processor 721 determines that a position failure has not occurred during the shear cycle, the horizon profile data is stored and organized based on the shear cycle (at step 828), and an index number is assigned to the shear cycle (at step 832). In some embodiments, an index number is first assigned to the shear cycle and then the horizon profile data is stored according to the assigned index number, such that it can be readily accessed and analyzed against past or future profile data. If, on the other hand, the processor 721 determines that a position failure has occurred, the processor 721 generates an alert at step 836. Once the alert is generated, the horizon profile data is stored according to the shear cycle (at step 828) and the shear cycle is assigned an index number (at step 832). Again, in some embodiments, the shear cycle is assigned an index number first and then the data is stored according to the index number.

The alert includes information about what components (i.e., the shearer, the right cutter, or the left cutter, or a combination) triggered the alert. The alert can be archived in the remote monitoring system 720 or exported to the service center 725 or elsewhere. For example, the remote monitoring system 720 can archive alerts to later be exported for reporting purposes. The information transmitted by the alert can include identifying information of the particular components, as well as the corresponding time point, the corresponding position of the components, and the corresponding positional bins. The alert can take several forms (e.g., e-mail, SMS messaging, etc.). As discussed above referring to the health monitoring system 700, the alert is communicated to appropriate participants near or remote to the mine.

As also discussed above, the processor 721 identifies a start point and an end point of a shear cycle based on the shearer position data. To identify the start and end of a shear cycle, the processor 721 first determines whether the shearer 110 cuts in a unidirectional manner or in a bidirectional manner. When the shearer 110 cuts in a unidirectional manner, the shearer 110 takes two shearer passes of the coal face to extract one web of coal. When the shearer 110 cuts in a bidirectional manner, the shearer 110 takes one shearer pass of the coal face to extract a web of coal.

In a unidirectional shear cycle, the shearer 110 partially cuts a web of coal while traveling in one direction (e.g., from the tailgate to the maingate) and cuts the remainder of the web when travelling in the reverse direction. In unidirectional operation, the roof supports 105 advance as the shearer 110 passes in one direction and push the AFC 115 as the shearer 110 passes in the opposite direction. In unidirectional operation the shearer 110 and pan-line generally snake into the next web of coal at either the tailgate or maingate ends of the coal face. Unidirectional operation can be configured for forward snake, in which the shearer 110 follows a pan-line snake into the next web as it enters the gate (e.g., maingate or tailgate), or backward snake, where the shearer 110 follows a pan-line snake into the next web as it leaves the gate (e.g., maingate or tailgate).

Figure 11A:
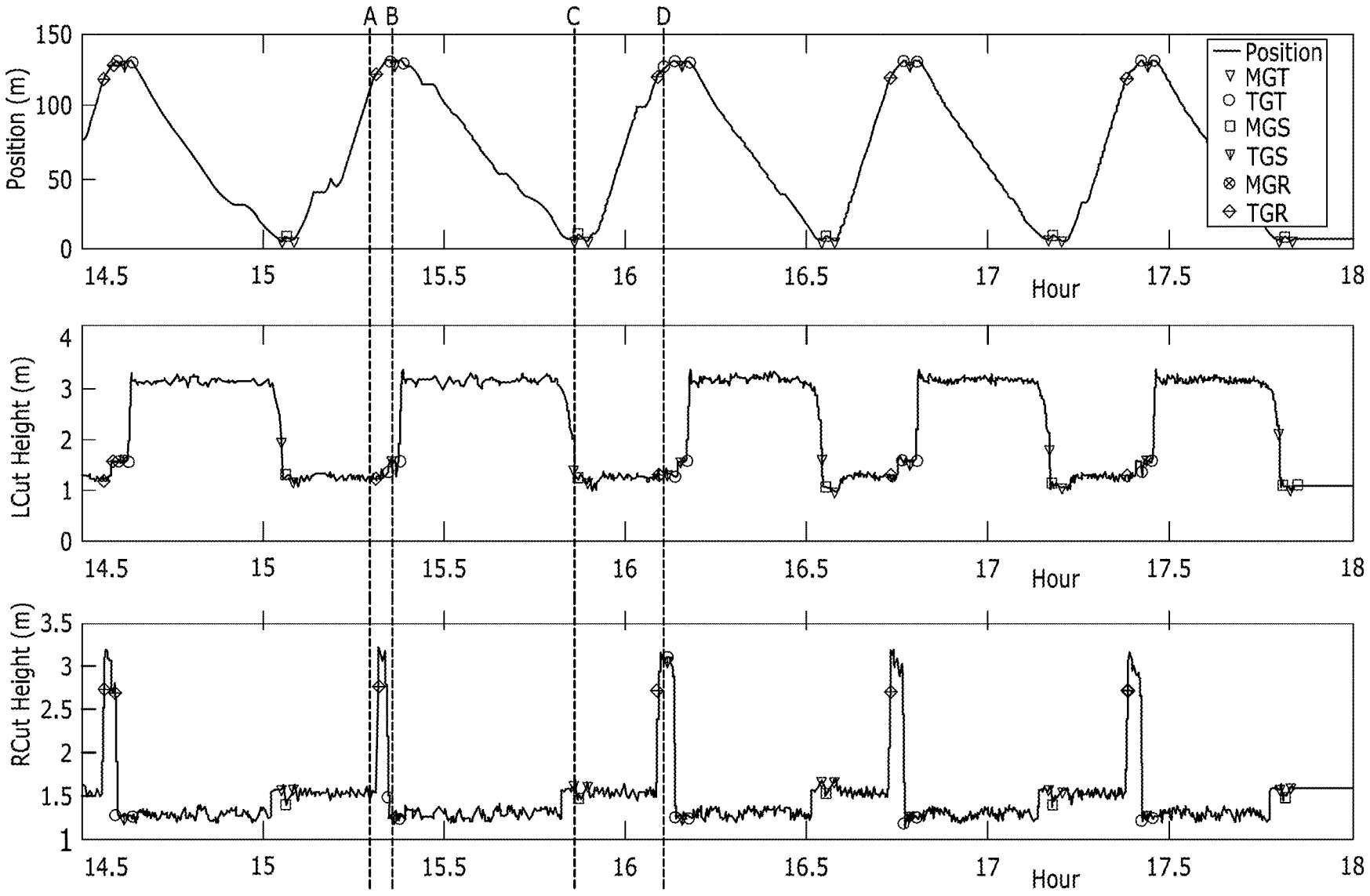
FIG. 11A illustrates a graph showing the shearer position along a coal face vs. time in a unidirectional shear cycle.

FIG. 11A shows an example of unidirectional operation with a forward snake in the tailgate. In the illustrated example, the shearer 110 cuts most of the extraction (e.g., web of coal) on the tailgate to maingate pass and cleans up spillage on the reverse pass (e.g., maingate to tailgate). FIG. 11A illustrates a first graph with an x-axis corresponding to time and a y-axis corresponding to the face position of the shearer 110 (e.g., the positional bin of the shearer 110), a second graph with an x-axis corresponding to time and a y-axis corresponding to the vertical position (e.g., height) of the left cutter drum 240, and a third graph with an x-axis corresponding to time and a y-axis corresponding to the vertical position (e.g., height) of the right cutter drum 235. On the y-axis, position zero corresponds to the maingate and position 150 corresponds to the tailgate. In this example, the shearer 110 starts the unidirectional shear at point A (e.g., position close to 150) and has the right cutter drum 235 on the tailgate side and the left cutter drum 240 on the maingate side. At point A, the shearer 110 follows a pan-line snake into a new web of coal. The cutter drum 235 closest to the tailgate is then raised to the roof level as the shearer 110 enters the tailgate. At point B, the shearer 110 stops at the tailgate, the cutter drum 235 closest to the tailgate is lowered to the floor level, and the cutter drum 240 closest to the maingate is raised to the roof level. The shearer 110 then trams from the tailgate to the maingate and cuts the upper section of the coal face with the (leading) cutter drum 240, and cuts the bottom section of the coal face with the (following) cutter drum 235.

The roof supports 105 advance as the shearer 110 passes to support the newly exposed strata, but the roof supports 105 do not propel the AFC 115 forward at this point. When the shearer 110 reaches the maingate (point C), the leading cutter drum 240 closest to the maingate lowers to floor level and the cutter drum 235 closest to the tailgate is raised so it is above floor level, but below roof level. The shearer 110 then begins moving back toward the tailgate to cut the lower section of the coal face near the maingate that could not be reached by the cutter drum 235 closest to the tailgate as the shearer 110 entered the maingate. Once the lower section of the coal face is extracted by the cutter drum 240 closest to the maingate, the shearer 110 then continues movement back toward the tailgate cleaning any spilled floor coal. The roof supports 105 push the AFC 115 pans forward as the shearer 110 travels back to the tailgate. As the shearer 110 follows the pan-line into the tailgate it will again enter a forward snake at point D. At point D, the shearer 110 raises the now leading cutter drum 235 (e.g., the cutter drum closest to the tailgate) and starts to cut the next web to begin a new shear cycle. Thus, the start and end of the unidirection shear cycle is marked and identified by the raising of the lead cutter drum 235, 240 as the shearer snakes into next web of coal. In some embodiments, the shearer 110 trams into the tailgate and trams out (e.g., shuffles) before raising the lead cutter drum 235, 240.

Figure 11B:
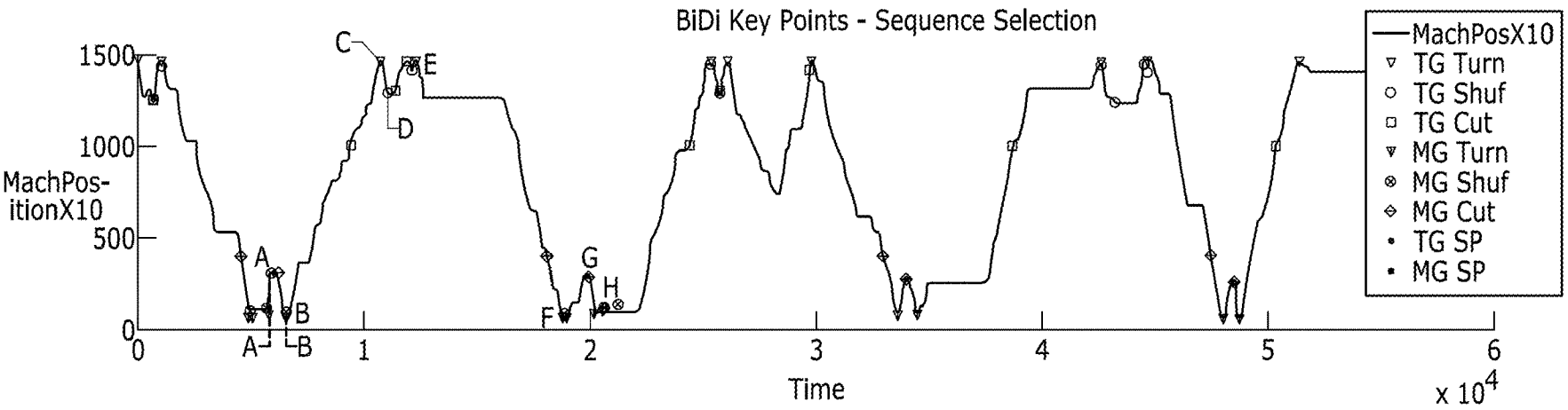
FIG. 11B illustrates a graph showing the shearer position along a coal face vs. time in a bidirectional shear cycle.

In a bidirection shear cycle, the shearer 110 cuts a web of coal both on the pass from the maingate to the tailgate and from the tailgate to the maingate. For example, the shearer 110 takes a complete seam extraction as the shearer 110 cuts from the maingate to the tailgate and another complete seam extraction as the shearer 110 cuts from the tailgate to the maingate. In the bidirectional shear cycle, the roof supports 105 advance and push the AFC 115 after the shearer 110 passes in one direction. In bidirectional operation, the shearer 110 completes a gate-end shuffle when the shearer 110 reaches the opposite gate. FIG. 11B illustrates an example of bidirectional operation of the shearer 110. In the example, the shearer 110 starts at the maingate and cuts the full extraction as the shearer 110 travels to the tailgate. FIG. 11B illustrates a graph with an x-axis corresponding to time and a y-axis corresponding to the face position of the shearer 110. On the y-axis, position zero corresponds to the maingate and position 1500 corresponds to the tailgate. In this example, the cutter drum 235 is on the tailgate side and the cutter drum 240 is on the maingate side. Point A on the graph shows the start of the bidirectional shear cycle with the position of the shearer 110 at the maingate snake point. As the shearer 110 trams into the forward snake toward the maingate, the (leading) cutter drum 240 cuts the upper section of the coal face. When the shearer 110 meets the gate stop (point B), the (leading) cutter drum 240 ranges down to floor level, and the (following) cutter drum 235 is raised to roof level. As the shearer 110 retrocedes away from the maingate, the (now following) cutter drum 240 (e.g., the cutter drum closest to the maingate) cuts the bottom section of the coal face that could not be reached as the shearer 110 entered the maingate. Once the shearer 110 clears the maingate, the roof supports 105 between the shearer 110 and the maingate advance toward the coal face and push the AFC 115 pans forward forming a forward snake. The shearer 110 then trams toward the tailgate with the (now leading) cutter drum 235 raised to roof level and the (following) cutter drum 240 lowered to floor level. As the shearer 110 travels toward the tailgate, the shearer 110 cuts a complete coal web and the roof supports 105 advance and push the AFC pans 115 behind the shearer 110 thereby enabling the shearer 110 to cut the next web on the return pass to the maingate. Point C on the graph illustrates the shearer 110 reaching the tailgate. Once at point C, the shearer 110 lowers its lead cutter drum 235 to floor level and then retrocedes until the shearer 110 reaches the tailgate snake point, point D on the graph. The distance that the shearer 110 retrocedes is approximately equal to the length of the shearer 110 from the cutter drum 235 to the cutter drum 240. Point D marks the end of the bidirectional shear cycle and the start of the next bidirectional shear cycle. The bidirectional shear cycle is marked and identified with two forward moving points that have at least a tailgate and maingate turn between them.

In some embodiments, and as discussed above, the horizon profile and/or the shearer position data is received by the processor 721 in a regular time interval (e.g., every 5 minutes). The time interval, however, does not necessarily align with a single shear cycle. Accordingly, the processor 721 analyzes the shearer position data to identify key points indicative of start and end points of a shear cycle. For instance, the processor 721 identifies one or more of the following key points: turn points of the shearer 110 at both the maingate and the tailgate, changes of direction of the shearer 110 (i.e., shuffle points), and raising of the cutter drums 235, 240 within close proximity to the maingate or to the tailgate. The processor 721 identifies the key points by searching the position data for the shearer 110 for minima and maxima, which correspond to both the gate turn points and the shuffle points. The processor 721 also determines if the cutter drums 235, 240 raise above a predetermined height threshold near the maingate or the tailgate. Once the shear cycle is identified, the processor 721 determines the time region (i.e., a start time and an end time) corresponding to the shear cycle. The processor 721 also determines the start and end points (e.g., a data point indicative of the start of the shear cycle and a data point indicative of the end of the shear cycle) corresponding to the shear cycle.

Once the processor 721 identifies the shear cycle, the processor 721 generates a pan-line profile, a roof cut profile, a floor cut profile, a pitch profile, and an elevation profile associated with the shearer's path through the shear cycle. As discussed above, the shearer 110 travels from the maingate to the tailgate (or vice versa). The shearer 110 supports a right cutter drum 235 and a left cutter drum 240. As the shearer 110 travels in one direction, one of the cutter drums 235, 240 is positioned higher than the other cutter drum such that the height of the coal seam is sheared. In one example, while the shearer 110 travels from the maingate to the tailgate, the right cutter drum 235 is raised and cuts the upper half of the coal face and the left cutter drum 240 cuts the bottom half of the coal face. On the return path, the shearer 110 travels from the tailgate to the maingate, the left and right cutter drums 240, 235 may maintain the same upper and bottom position as on the forward pass or may switch positions.

The pan-line represents the floor plane of the AFC 115 and corresponds to the path followed by the shearer 110 as it traverses the AFC 115. The pan-line is calculated using the angular (e.g., roll and pitch angles) and lateral (e.g., position along the coal face 303 determined using the haulage sensors 270, 275) position measurements of the shearer 110. The roof cut profile corresponds to the position of the cutter drum 235, 240 cutting the upper half of the coal face, and the floor cut profile corresponds to the position of the cutter drum 235, 240 cutting the bottom half of the coal face. The position of the cutter drums 235, 240 to generate the roof cut and floor cut profiles may be calculated based on the center of the cutter drums 235, 240, a top edge of the cutter drums 235 including or excluding the mining bits, a bottom edge of the cutter drums 235, 240 including or excluding the mining bits, or other similar location of the cutter drums 235, 240. Additionally, the position of the cutter drums 235, 240 to generate the floor and roof cut profiles are calculated with reference to the pan-line To generate the roof cut profile and the floor cut profile, the path of each of the cutter drums 235, 240 is estimated relative to the pan line. The shearer position is added to the relative cutter center's position to convert the relative cutter centers' position into an absolute cutter centers' position relative to the pan-line. Once the cutters' path has been computed, each center position (for the right cutter drum 235 and the left cutter drum 240) is binned within discrete position intervals. In some embodiments, the discrete position intervals correspond to a roof support index as described above, or a group of roof supports (i.e., each position index corresponds to 6 roof supports), or a fraction of a roof support. The roof cut is then computed as the maximum center height within each position bin plus the radius of the cutter drum 235, 240. Similarly, the floor cut is computed as the minimum center height within each position bin minus the radius of the cutter 235, 240. The pitch and elevation profiles are calculated using the average of the pitch data and the roll data, respectively, in each of the position bins.

Figure 12:
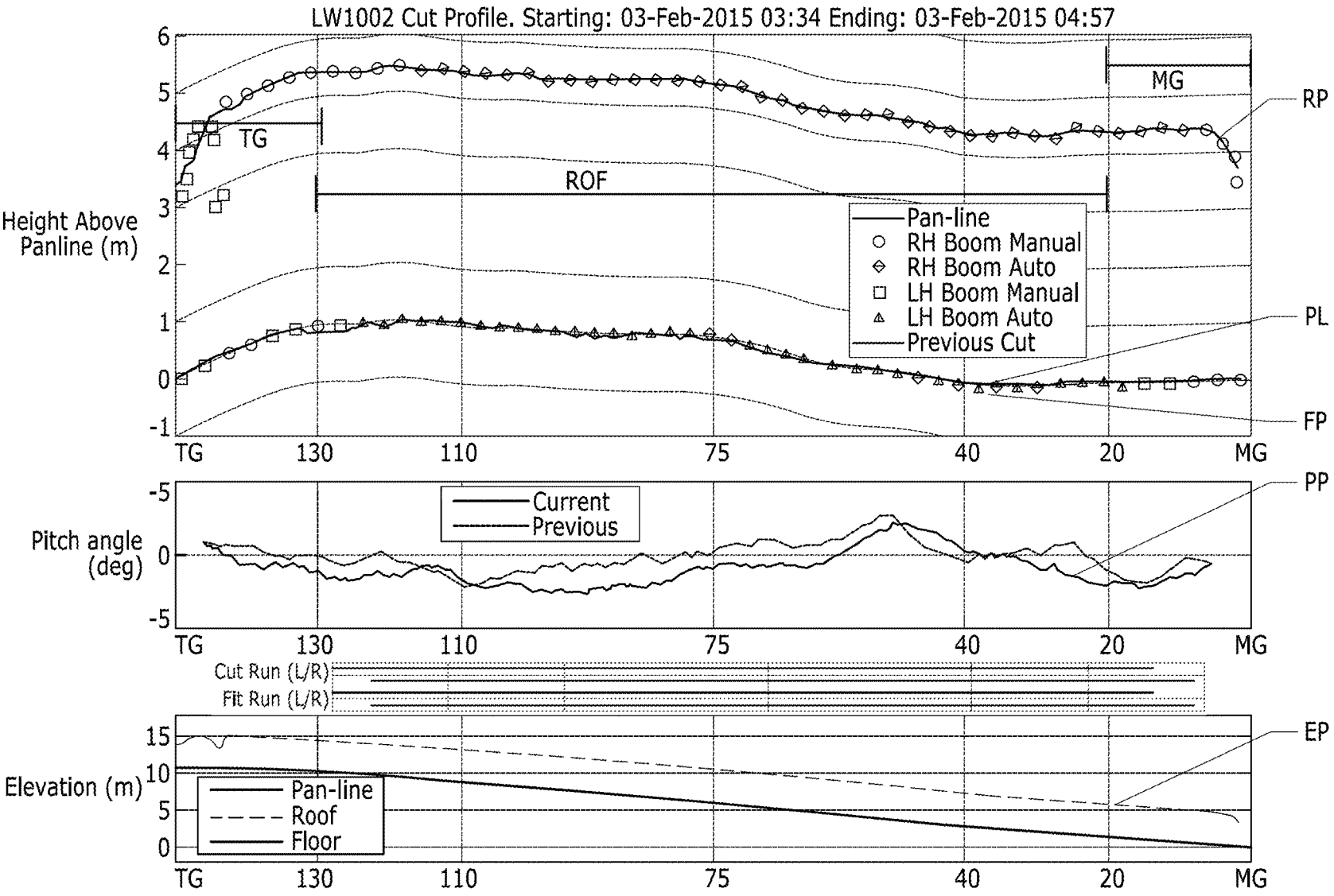
FIG. 12 illustrates horizon data corresponding to one shear cycle.

Once the roof cut profile, the pan-line profile, the floor cut profile, the pitch profile, and the elevation profile have been computed for a given shear cycle, the processor 721 determines whether each of the profiles is within normal operational parameter ranges. An exemplary plot of a shear cycle is shown in FIG. 12 including the roof cut profile (RP), the pan-line profile (PL), the floor cut profile (FP), the pitch profile (PP), the elevation profile (EP), an. In the illustrated embodiment, the processor 721 checks four parameters for each shear cycle: floor step, extraction, pitch, and roll rate.

Figure 13:
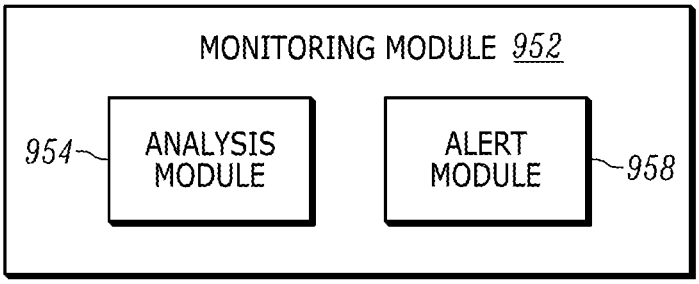
FIG. 13 illustrates a monitoring module of the extraction system.

FIG. 13 illustrates a monitoring module 952 that can be implemented in the processor 721. In some embodiments, the monitoring module 952 may be software, hardware, or a combination thereof, and may be local to the longwall mining system 100 (e.g., underground or aboveground at a mine site) or it may be remote from the longwall system 100. The monitoring module 952 monitors the shearer position data obtained by the sensors 260, 265, 270, 275, 280. The monitoring module 952 includes an analysis module 954 and an alert module 958, whose functionality are described below. In some instances, the monitoring module 952 is implemented in part at a first location (e.g., at a mine site) and in part at another location (e.g., at the remote monitoring system 720). For instance, the analysis module 954 may be implemented on the main controller 775, while the alert module 958 is implemented on the remote mining system 720, or part of the analysis module 954 may be implemented underground while another part of the analysis module 954 may be implemented aboveground.

The analysis module 954 analyzes the floor cut profile, the roof cut profile, the pan-line profile, the pitch profile, and the elevation profile in relation to the floor step parameter, the extraction parameter, the pitch parameter, and the roll rate parameter. The floor step parameter refers to a difference between the pan line profile and the floor cut profile. If the floor step exceeds a threshold, the longwall mining system 100 may have an adverse pan pitching response when the system 100 (i.e., the roof supports 105 and the AFC 115) advances. For example, large step changes in the floor profile can lead to sudden changes in pan pitch attitude, which can cause the horizon to quickly deviate off the coal seam. Large step changes can also impact the ability of the roof supports 105 to advance cleanly, which can further impact the ability to control the horizon along the coal face. In some instances, large floor steps can cause the shearer 110 to collide with the canopies 315.

The floor cut profile is divided up into a maingate section (MG), a run-of-face section (ROF), and a tailgate section (TG) based on the pan position of the shearer 110, as illustrated in FIG. 12. The maingate section (MG) of the data includes floor cut profile data of the shearer 110 between the maingate (e.g., roof support position 0) and a first maingate threshold (e.g., roof support position 20). The run-of-face section (ROF) of the data includes floor cut profile data of the shearer 110 between the first maingate threshold (e.g., roof support position 20) and a first tailgate threshold (e.g. roof support position 130). The tailgate section (TG) of the data includes floor cut profile data of the shearer 110 between the first tailgate threshold (e.g., roof support position 130) and the tailgate (e.g, roof support position bin 150). In some embodiments, the pan-line profile, the roof cut profile, the pan pitch profile, and the elevation profile are each also divided into a maingate section (MG), a run-of-face section (ROF), and a tailgate section (TG), as described above with respect to the floor cut profile.

Figure 14:
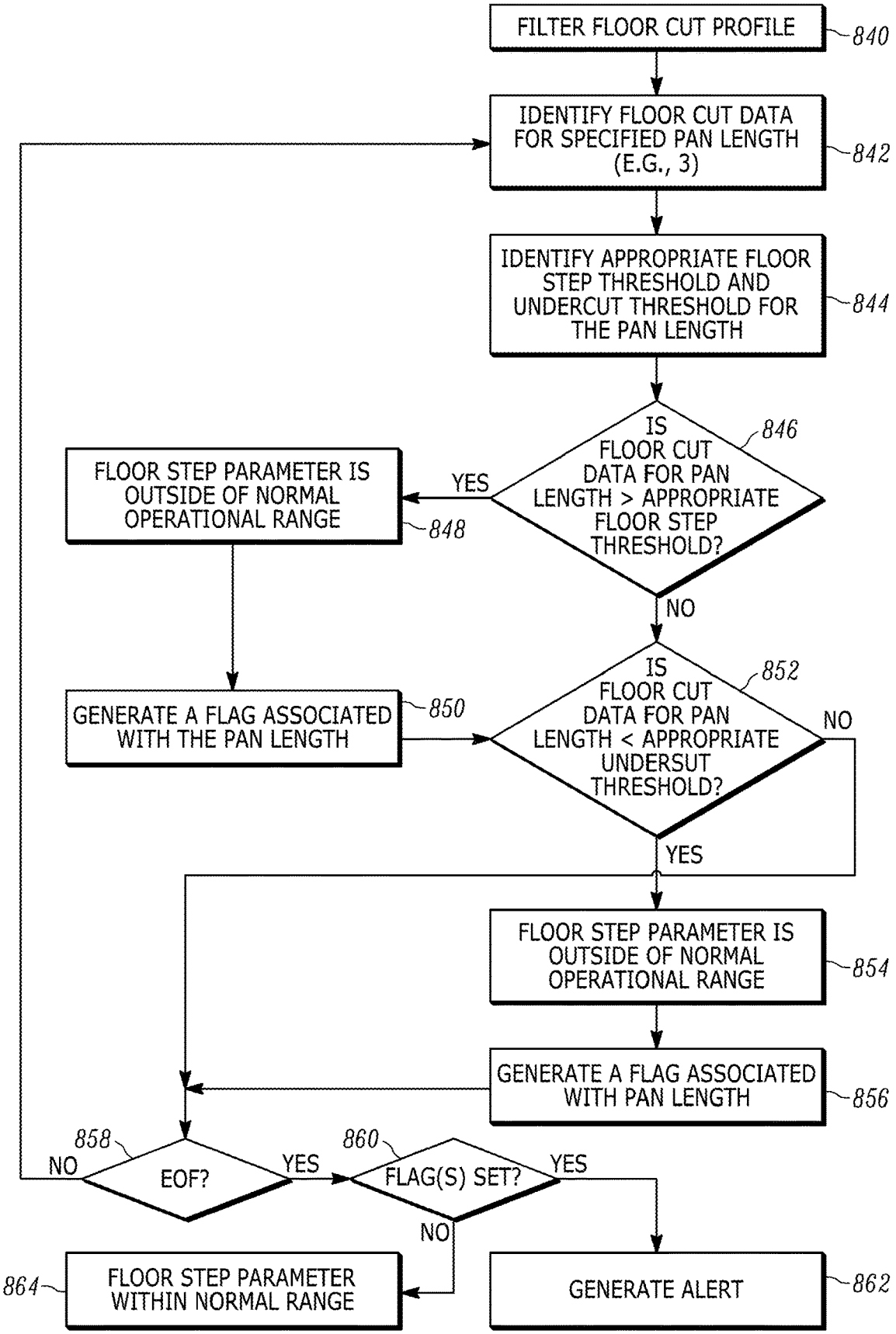
FIG. 14 illustrates a method of monitoring a floor step parameter of a floor cut profile.

The analysis module 954 analyzes the maingate section (MG), the run-of-face section (ROF), and the tailgate section (TG) of the floor cut profile separate from each other. In some embodiments, the analysis module 954 applies different thresholds to each section of the floor cut profile. FIG. 14 illustrates a method implemented by the analysis module 954 to determine whether the shearer 110 operates within the normal operational range of the floor step parameter. First, at step 840, the analysis module 954 filters the floor cut profile. The analysis module 954 filters the floor cut profile to reduce the number of data points for the floor cut profile and remove any outlying data points. For example, in one embodiment, the floor cut profile includes one data point for every positional bin corresponding to each roof support 105 (e.g., 134 data points). By filtering the floor cut profile data using, for example, a window filter of two position bins, an indicative point can be assigned to every group of two position bins.

For example, in an unfiltered floor cut profile, for the first position bin the floor cut data is 0 meters, for the second position bin the floor cut data is −0.4 meters, for the third position bin the floor cut data is −0.8 meters, for the fourth position bin the floor cut data is −0.85 meters, for the fifth position bin the floor cut data is −0.95 meters, and for the sixth position bin the floor cut data is −0.98 meters. A filtered floor cut profile may group the first and second position bins together to assign a value to a first pan position, group the third and fourth position bins together to assign a value to a second pan position, and group the fifth and sixth position bins together to assign a different value to a third pan position. In one example, an average of the floor cut data of the position bins grouped together for one pan position is used to assign a value to the pan position. In the example above, the first pan position has a value of −0.2 meters, the second pan position has a value of −0.825 meters, and the third pan position has a value of −0.965 meters. A difference between one pan position (e.g., the first pan position) and another pan position (e.g., the third pan position) corresponds to a pan length (e.g., 2 pan positions). Thus, filtering the floor cut profile data can reduce the amount of data analyzed by the analysis module 954 and may, in some instances, make the analysis faster and more efficient. In some embodiments, the filtering process does not calculate an average. Rather, in some embodiments, the filtering process assigns the highest value to the filtered position bins, the lowest value, or the median value of the filtered position bins. In some embodiments, the window filter is higher than two position bins.

At step 842, the analysis module 954 identifies floor cut profile data corresponding to a predetermined pan length for the associated parameter (e.g., the floor step parameter). The predetermined pan length indicates the minimum number of consecutive pan positions for which the floor step parameter operates outside of the normal operational range for the alert module 958 to generate an alert. In the illustrated embodiment, the predetermined pan length for the floor cut parameter is three pan positions. The analysis module 954 determines if a parameter operates within or outside of normal operational ranges by determining if a parameter (e.g., the floor step parameter) is below or above a particular operational threshold for a predetermined pan length. If, for example, the parameter exceeds the particular operational threshold (e.g., the floor step threshold) for less than the predetermined pan length (e.g., for one pan position instead of 3 pan positions), the analysis module 954 determines that the parameter (e.g., the floor step parameter) still operates within the normal operational range. In other words, the analysis module 954 determines if 3 or more consecutive data points of the filtered floor cut profile exceed a floor step threshold. While describing how the analysis module 954 analyzes the horizon profile data with regard to the other parameters (e.g., the roof cut parameter, the pitch parameter, the extraction parameter, and the like), the analysis module 954 determines whether a particular parameter exceeds or is below a threshold for a predetermined pan length. It should be understood that in some embodiments, the analysis module 954 determines that the particular parameter is outside the normal operational range for the pan length only when the predetermined number of consecutive data points all exceed (or are below) the threshold.

In other embodiments, the predetermined pan length is less or more than three consecutive pan positions. In some embodiments the predetermined pan length changes based on the parameter. For example, the floor cut parameter may have a predetermined pan length of three consecutive pan positions while the extraction parameter may have a predetermined pan length of five consecutive pan positions.

At step 844, the analysis module 954 identifies the appropriate floor step threshold and the appropriate undercut threshold to be used for the identified predetermined pan length. The appropriate floor step threshold and undercut threshold can be based on, for example, which section of data the predetermined pan length corresponds to. For example, if the floor cut data in the predetermined pan length corresponds to the maingate section of the floor cut profile, the analysis module 954 may use a maingate floor step threshold and a maingate undercut threshold. If, however, the floor cut data in the predetermined pan length corresponds to the run-of-face section of the floor cut profile, the analysis module 954 may use a run-of-face floor step threshold and a run-of-face undercut threshold. Similarly, if the floor cut data for the predetermined pan length corresponds to the tailgate section of the floor cut profile, the analysis module 954 may use a tailgate floor step threshold and a tailgate undercut threshold.

At step 846, the analysis module 954 determines if the floor cut data is greater than the appropriate floor step threshold (e.g., 0.2 meters) for the predetermined pan length (e.g., three pan positions). If the analysis module 954 determines that the floor cut data in the predetermined pan length is greater than the floor step threshold, the analysis module 954 determines that the floor step parameter operates outside a normal operational range for that predetermined pan length (step 848) and sets a flag associated with the predetermined pan length (step 850). The flag indicates that a position failure associated with the floor step parameter was determined for the identified pan length. Once the flag is set, the analysis module 954 proceeds to step 852. If, on the other hand, the analysis module 954 determines that the floor cut data in the predetermined pan length is not greater than the floor step threshold, the analysis module 954 determines that the floor cut data for the identified pan length operates within normal operating range and continues to analyze the floor cut data in relation to the undercut threshold.

At step 852, the analysis module 954 determines if the floor cut data in the predetermined pan length is less than the appropriate undercut threshold (e.g., −0.3 meters). If the analysis module 954 determines that the floor cut data in the predetermined pan length is less than the undercut threshold, the analysis module 954 determines that the floor step parameter operates outside the normal operational range for the predetermined pan length (step 854) and sets a flag associated with the predetermined pan length (step 856). The flag, as mentioned above, indicates that a position failure associated with the floor step parameter was determined for the identified pan length. Once the flag is set, the analysis module 954 determines if the end of file (i.e., the end of the horizon profile data for the shear cycle) is reached (step 858). If, on the other hand, the analysis module 954 determines that the floor cut data in the predetermined pan length is not less than the undercut threshold, the analysis module 954 determines that the floor cut data is within normal operational range for the identified pan length and then determines if the end of file has been reached (step 858).

If the end of file is not yet reached, the analysis module 954 proceeds to step 842 to identify floor cut data for another predetermined pan length. For example, if at first the analysis module 954 analyzes floor cut data corresponding to a pan length including pan positions 1, 2, and 3, when the analysis module 954 determines that the end of file is not yet reached, the analysis module 954 identifies floor cut data corresponding to, for example, pan positions 2, 3, 4, since pan positions 2, 3, and 4 correspond to the next set of three consecutive pan positions. When the end of file is reached, the analysis module 954 determines if any flags have been set for the floor cut profile data of the shear cycle (step 860). If the analysis module 954 determines that flags were set while analyzing floor cut data for the shear cycle, the alert module 958 generates an alert as described above (step 862). If, on the other hand, the analysis module 954 determines that flags were not set while analyzing floor cut profile data for the shear cycle, the analysis module 954 determines that the floor cut parameter operates in the normal operational range during the shear cycle and no alert is generated (step 864).

Figure 15:
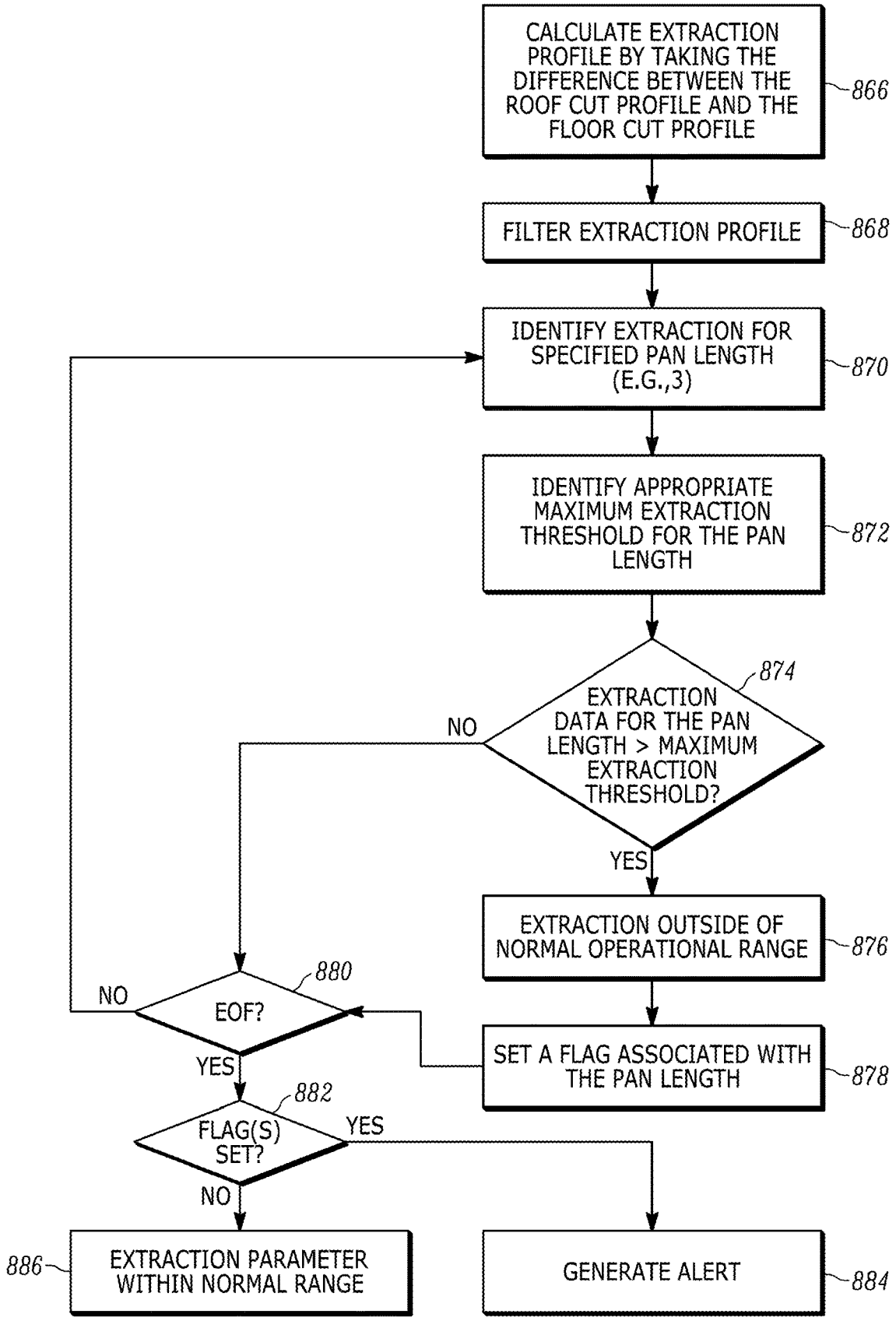
FIG. 15 illustrates a method of monitoring an extraction parameter of the shearer.

FIG. 15 illustrates a method implemented by the analysis module 954 to determine whether the shearer 110 operates within the normal operational range for the extraction parameter. The extraction parameter refers to how much coal is being extracted from the mine. Over extraction can cause the quality of the coal to decrease, for example, if non-coal material is also being extracted. Over extraction can also weaken the support for overlying strata, which can cause cavities to form as described earlier. First, at step 866, the analysis module 954 calculates an extraction profile by taking the difference between the roof cut profile and the floor cut profile. Then, the analysis module 954 filters the extraction profile at step 868 to reduce the number of data points for the extraction profile as described with respect to the floor cut profile in FIG. 14. In the illustrated embodiment, the analysis module 954 filters the extraction data with a window filter of two position bins such that one pan position includes information based on two positional bins. The analysis module 954 then identifies extraction data for a predetermined pan length for the extraction parameter, at step 870. In the illustrated embodiment, the predetermined pan length for the extraction parameter is three pan positions. At step 872, the analysis module 954 identifies the appropriate maximum extraction threshold for the identified predetermined pan length. The appropriate maximum extraction threshold may be different based on whether the identified pan length is part of the maingate section, run-of-face section, or tailgate section of the extraction profile.

At step 874, the analysis module 954 determines whether the extraction data for the predetermined pan length is greater than the appropriate maximum extraction threshold (e.g., 4.8 meters). If the extraction data for the pan length is greater than the appropriate maximum extraction threshold, the analysis module 954 determines that the extraction parameter operates outside the normal operational range (step 876) and sets a flag associated with the identified pan length (step 878). The flag indicates that a position failure associated with the extraction parameter was determined for the identified pan length. Once the flag is set, the analysis module 954 determines if the end of file (i.e., the end of the horizon profile data for the shear cycle) has been reached (step 880). If, on the other hand, the extraction data for the identified pan length is not greater than the appropriate maximum extraction threshold, the analysis module 954 goes to step 880 to determine if the end of file has been reached.

If the end of file is not yet reached, the analysis module 954 proceeds to step 870 to identify extraction data corresponding to another predetermined pan length as described above with reference to step 842. When the end of file is reached, the analysis module 954 determines if any flags have been set for the extraction data for the shear cycle, at step 882. If the analysis module 954 determines that flags were set while analyzing extraction data for the shear cycle, the alert module 958 generates an alert (step 884). If the analysis module 954 determines that flags were not set while analyzing the extraction data for the shear cycle, the analysis module 954 determines that the extraction parameter operates in the normal operational range during the shear cycle and no alert is generated (step 886).

Figure 16:
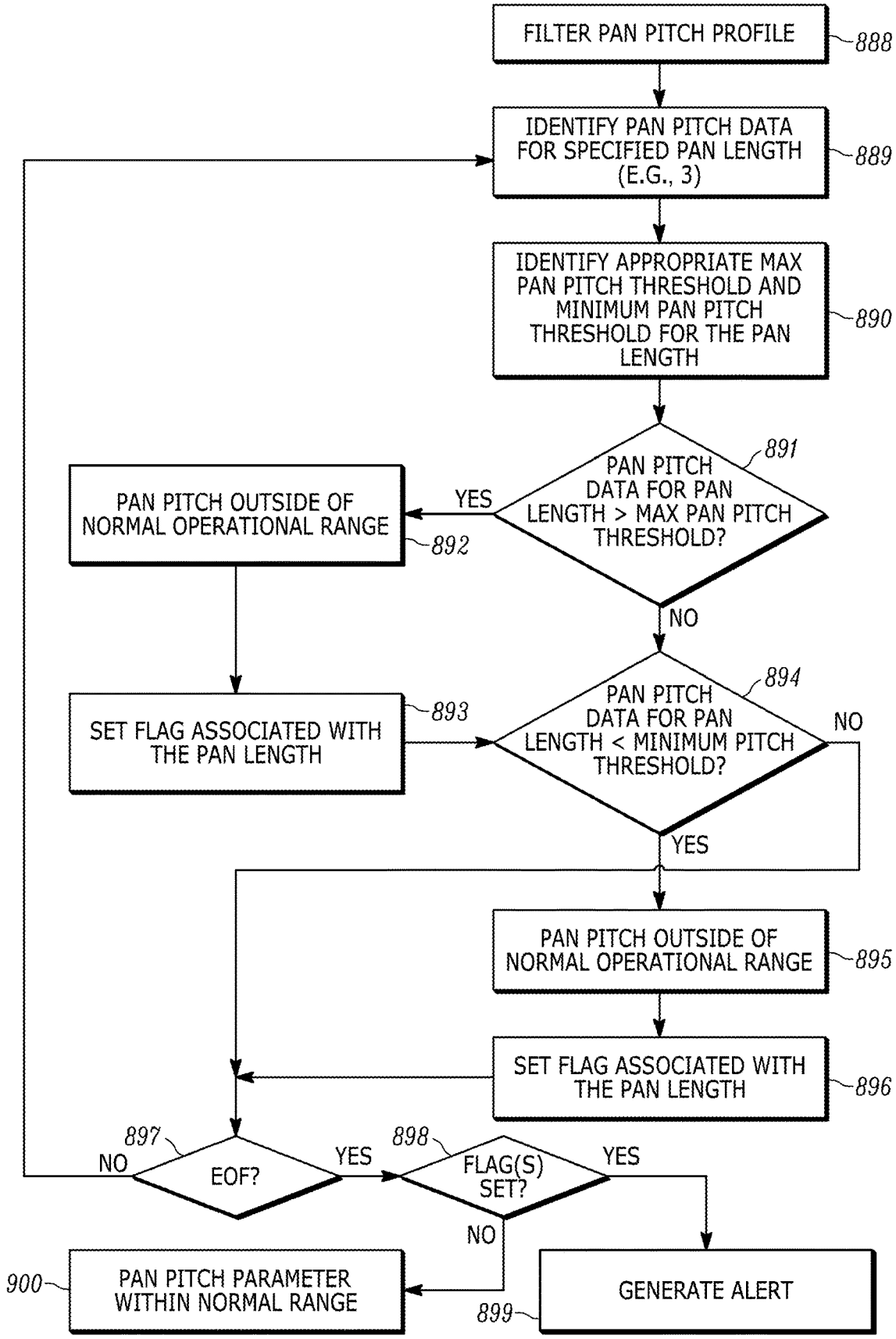
FIG. 16 illustrates a method of monitoring a pan pitch parameter of the shearer.

FIG. 16 illustrates a method implemented by the analysis module 954 to determine whether the shearer 110 operates within the normal operational range for the pitch parameter. First, at step 888, the analysis module 954 filters the pan pitch data to reduce the number of data points for the pan pitch profile data as described above with respect to the floor cut profile in FIG. 14. In the illustrated embodiment, the analysis module 954 filters the extraction data using a window filter of two positional bins such that one pan position includes information based on two positional bins. The analysis module 954 then identifies the pan pitch data for a predetermined pan length for the pan pitch parameter, at step 889. In the illustrated embodiment, the predetermined pan length for the pan pitch parameter is three pan positions (e.g., a pan length of three). At step 890, the analysis module 954 identifies the appropriate maximum and minimum pan pitch thresholds based on, for example, whether the identified pan length corresponds to the maingate section, the run-of-face section, or the tailgate section of the pan pitch profile. The maximum pan pitch refers to a maximum positive angular position (e.g., maximum tilt of the shearer 110 away from the coal face) and minimum pan pitch refers to a maximum negative angular position (e.g., maximum tilt of the shearer 110 toward the coal face). Once the appropriate thresholds are identified, the analysis module 954 analyzes the identified pan length of pan pitch data according to the appropriate thresholds.

At step 891, the analysis module 954 determines if the pan pitch data for the pan length is greater than a maximum pan pitch threshold (e.g., 6.0 degrees). If the pan pitch data for the pan length is greater than the appropriate maximum pan pitch threshold, the analysis module 954 determines that the pan pitch operates outside of the normal operational range (step 892) and sets a flag associated with the pan length (step 893). The flag indicates that a position failure associated with the pan pitch was determined at the identified pan length for the shear cycle. Once the flag is set, the analysis module 954 analyzes the pan pitch data according to the appropriate minimum pan pitch threshold (step 894). If, on the other hand, the pan pitch data for the pan length is not greater than the appropriate maximum pan pitch threshold, the analysis module 954 proceeds directly to step 894.

At step 894, the analysis module 954 determines if the pan pitch data for the identified pan length is below the appropriate minimum pan pitch threshold (e.g., −6.0 degrees). If the pan pitch data for the pan length is below the minimum pan pitch threshold, the analysis module 954 determines that the pan pitch parameter operates outside the normal operational range (step 895) and sets a flag associated with the pan length (step 896). The flag, as discussed above, indicates that a position failure associated with the pan pitch was determined at the identified pan length for the shear cycle. Once the flag is set, the analysis module 954 determines if the end of file (i.e., the end of the horizon profile data for the shear cycle) has been reached (step 897). If the pan pitch data for the pan length is not below the appropriate minimum pan pitch threshold, the analysis module 954 proceeds directly to step 897 to determine if the end of file has been reached.

If the end of file has not been reached, the analysis module 954 goes back to step 889 to identify another pan length and continue analyzing the pan pitch data for the shear cycle. When the end of file is reached, the analysis module 954 determines if any flags have been set (step 898). If flags have been set, the alert module 958 generates an alert (step 899). If flags have not been set, the analysis module 954 determines that the pan pitch parameter operates within the normal operational range and no alert is generated (step 900).

Figure 17:
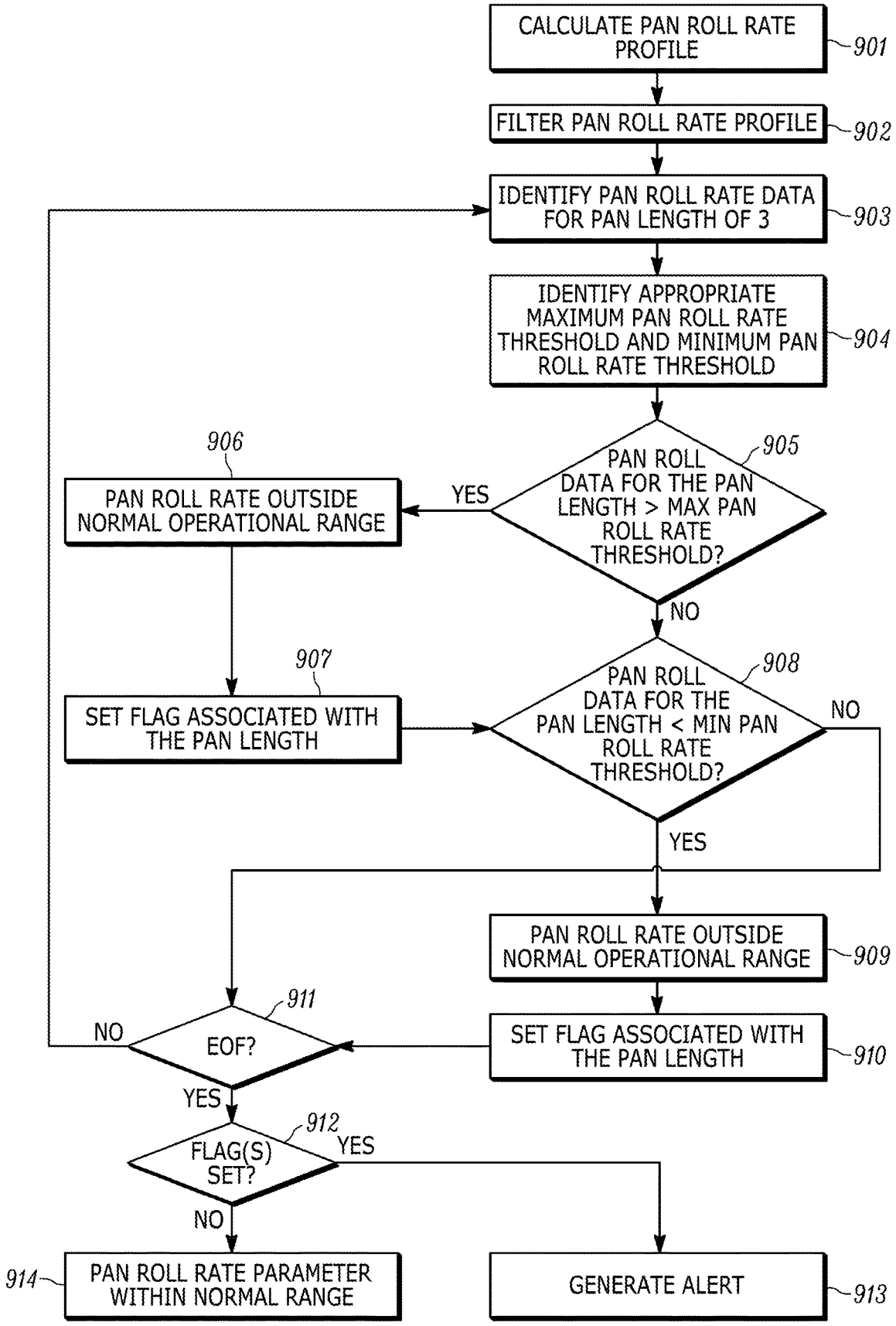
FIG. 17 illustrates a method of monitoring a pan roll parameter of the shearer.

FIG. 17 illustrates a method implemented by the analysis module 954 to determine whether the shearer 110 operates within the normal operational ranges for the pan roll rate parameter. First, the analysis module 954 calculates the pan roll rate profile data based on information obtained from the sensors 260, 265, 270, 275, 280 located on the shearer 110, at step 901. The pan roll rate profile indicates the degree of roll change per pan length. The pan roll rate profile is calculated for consecutive positional bins where the first positional bin is assumed to have a roll rate of zero. Then, the analysis module 954 filters the pan roll rate data as described above with respect to FIG. 14 (step 902). The analysis module 954 proceeds to identify pan rate roll data for a predetermined pan length, at step 903. In the illustrated embodiment, the predetermined pan length is three pan positions. At step 904, the analysis module 954 identifies an appropriate maximum pan roll rate threshold and minimum roll rate threshold for the pan length based on whether the identified pan length corresponds to the maingate section, the run-of-face section, or the tailgate section of the pan roll profile. The maximum and minimum pan roll rate refers to a maximum and minimum acceptable angular change sustained across a specified number of pan lengths.

At step 905, the analysis module 954 determines if the pan roll rate data for the predetermined pan length is greater than the appropriate maximum pan roll rate threshold (e.g., 0.5 degrees per pan length). If the pan roll rate data for the pan length is greater than the appropriate maximum pan roll rate threshold, the analysis module 954 determines that the pan roll parameter operates outside the normal operational range (step 906) and sets a flag associated with the identified pan length (step 907). The flag indicates that a position failure associated with the pan roll rate was determined for the shear cycle. Once the flag is set, the analysis module 954 continues analyzing the pan roll rate data and proceeds to step 908. If, on the other hand, the pan roll rate data for the pan length is not greater than the appropriate maximum pan roll rate threshold, the analysis module 954 goes directly to step 908 to determine if the pan roll rate data for the pan length is below the appropriate minimum pan roll rate threshold (e.g., −0.5 degrees per pan length). If the pan roll rate data for the identified pan length is below the minimum pan roll rate threshold, the analysis module 954 determines that the pan roll parameter operates outside the normal operational range (step 909) and generates a flag associated with the pan length (step 910). The flag indicates that a position failure associated with the pan roll rate was determined for the shear cycle. Once the flag is set, the analysis module 954 determines if the end of file (i.e., the end of the horizon profile data for the shear cycle) is reached at step 911. If, on the other hand, the pan roll rate data for the identified pan length is not below the minimum pan roll threshold, the analysis module 954 proceeds directly to step 911. If the end of file has not been reached, the analysis module 954 goes back to step 903 to identify pan roll rate data for a new pan length of three. When the end of file is reached, the analysis module 954 determines if any flags have been set during the shear cycle, at step 912. If flags have been set, the alert module 958 generates an alert at step 913. If no flags have been set, the analysis module 954 determines that the pan roll parameter operates within the normal operating range (step 914).

Once the analysis module 954 analyzes the shear cycle with respect to the floor step parameter, the extraction parameter, the pitch parameter, and the roll rate parameter, the horizon profile data for the shear cycle is stored in a database for later access. As described in FIGS. 14-17, a flag is set for every pan length during which the monitored parameters operate outside of the normal operational range. In the illustrated embodiment, if the analysis module 954 determines that the shearer 110 operates outside of the normal operational range for a given parameter in more than one instance (e.g., for more than one pan length) during the same shear cycle, the alert module 958 only generates one alert per cycle per parameter. In other embodiments, the alert module 958 generates an alert per instance (e.g., per identified pan length) that the shearer 110 operates outside of the normal operational parameter range. In some embodiments, the horizon profile data for each shear cycle is stored with a graphical image. The graphical image may illustrate graphs indicating the roof cut profile, the floor cut profile, the pan-line, the pitch profile, and the elevation profile, as illustrated in FIG. 12. When an alert is generated by the alert module 958, areas within the graphical image are highlighted (or contain an indication) to distinguish the data that triggered the flags and the alert.

It should also be understood that while a specific order was described for monitoring each parameter, the analysis module 954 may monitor the parameters in any given order. It should also be understood that although the floor cut profile, the roof cut profile, the extraction profile, the pan roll rate profile, and the pan pitch profile were described as being filtered, in some embodiments, the horizon profile data is not filtered and the entire data is used to analyze the horizon data with respect to a specific parameter. It should also be understood that while the floor cut profile, the roof cut profile, the extraction profile, the pan roll rate profile, and the pan pitch profile were described as being analyzed separately by a maingate section, a run-of-face section, and a tailgate section, the horizon profile data may be sectioned in a different manner, or not sectioned at all. In such embodiments, the horizon profile data is analyzed as a whole and the step of identifying appropriate thresholds may be bypassed by the analysis module 954.

The analysis module 954 also determines if the floor cut profile, the roof cut profile, the pan pitch profile, and the pan roll profile deviate significantly between two shear cycles. For example, since the horizon profile data for each shear cycle is stored in a database, the analysis module 954 can compare the horizon profile data from a previous shear cycle to the horizon profile data from a current shear cycle and determine if the difference in horizon profile data is significant. The analysis module 954 determines if a deviation in the floor cut profile between two shear cycles, or if a deviation in the roof cut profile between two shear cycles is significant. In the illustrated embodiment, the analysis module 954 analyzes two consecutive shear cycles. Generally, when the shearer 110 remains aligned with the coal face, the deviation in roof cut profile and floor cut profile between two consecutive cycles is relatively small. The analysis module 954 can also determine if consecutive changes in the pan pitch and the pan roll profiles (or pan roll rate profiles) are generally trending toward a warning level (e.g., a high pitch warning level, a low pitch warning level, a high roll warning level, or a low roll warning level). Excessive pan pitching or pan rolling may cause loss of horizon, and in extreme cases, the canopies 315 may collide with the shearer 110.

Figure 18:
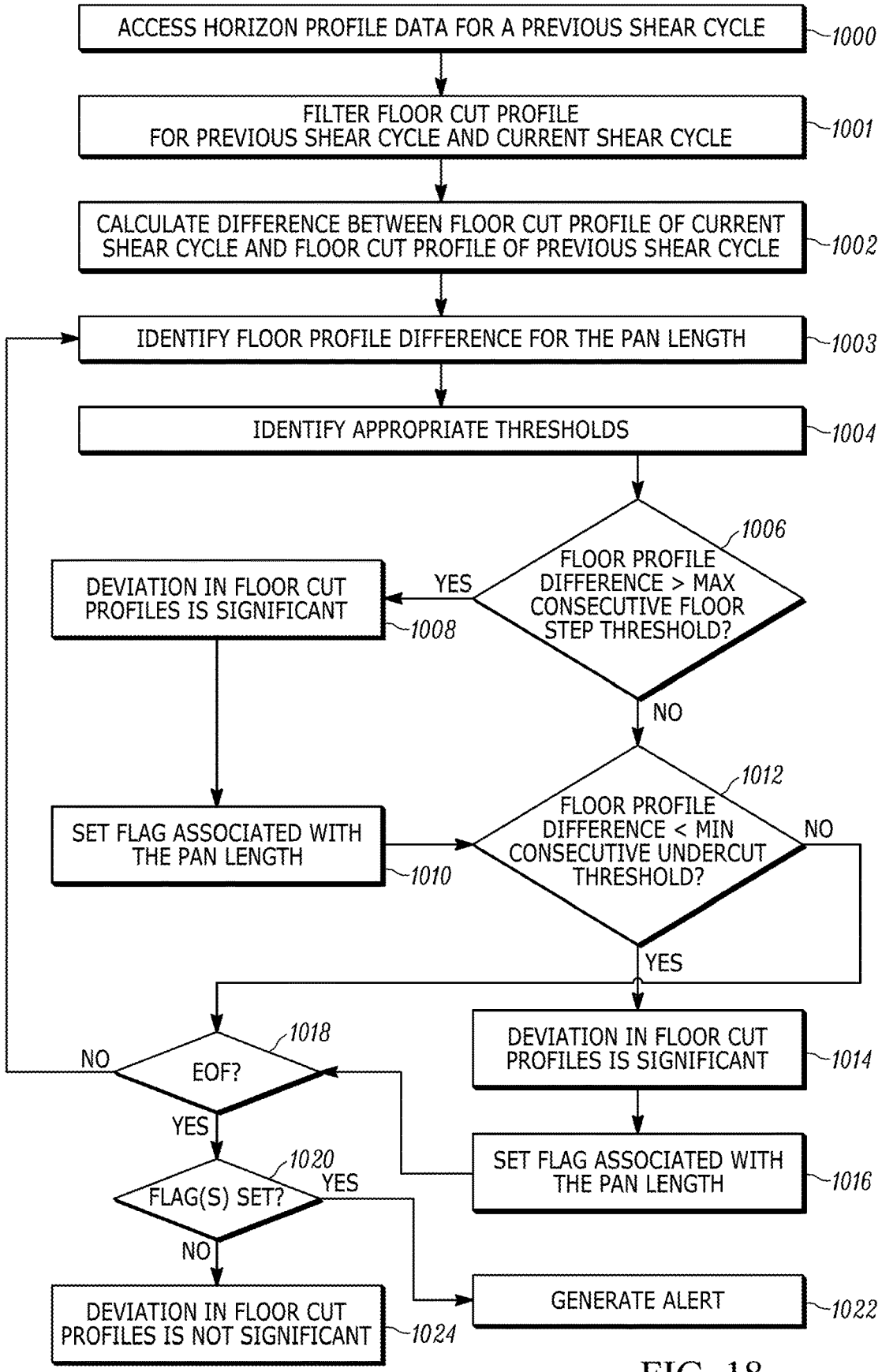
FIG. 18 illustrates a method of monitoring a consecutive floor step of two floor cut profiles.

FIG. 18 illustrates a method implemented by the analysis module 954 to determine if the deviation in the floor cut profile between two shear cycles is significant. First, at step 1000, the analysis module 954 accesses horizon profile data for a previous shear cycle. The previous shear cycle can be the consecutively previous cycle or simply a shear cycle that has already been analyzed. The analysis module 954 then filters the floor cut profile for the previous shear cycle and the floor cut profile for the current shear cycle to reduce the number of data points (step 1001). The analysis module 954 then calculates a difference between the filtered floor cut profile of the current shear cycle and the filtered floor cut profile of the previous shear cycle, at step 1002. Then, the analysis module 954 identifies the floor cut profile difference for a predetermined pan length (e.g., 3 pan positions), at step 1003. Once the floor cut profile difference data for the pan length has been identified, the analysis module 954 identifies the appropriate floor cut deviation thresholds, at step 1004. The floor cut deviation thresholds include a maximum consecutive floor step threshold and a minimum consecutive undercut threshold. The appropriate thresholds may be based on, for example, whether the floor profile difference data for the pan length corresponds to the maingate section, the run-of-face section, and the tailgate section of the floor profiles. In some embodiments, the analysis module 954 may not need to identify appropriate floor cut deviation thresholds if the floor cut profile data is not sectioned. The analysis module 954 then determines if the floor profile difference for the identified pan length is greater than the appropriate maximum consecutive floor step threshold, at step 1006.

If the floor profile difference for the pan length is greater than the consecutive floor step threshold (e.g., 0.3 meters), the analysis module 954 determines that the deviation in floor cut profiles between the two shear cycles is significant (step 1008) and sets a flag associated with the associated pan length (step 1010). The flag indicates that the deviation of the floor cut profile between the current shear cycle and the previous shear cycle is significant. Once the flag has been set, the analysis module 954 proceeds to step 1012. Similarly, if the analysis module 954 determines that the floor profile difference for the pan length is not greater than the maximum consecutive floor step threshold, the analysis module 954 proceeds to analyze the floor cut profile difference with respect to the consecutive undercut threshold (step 1012).

At step 1012, the analysis module 954 determines if the floor cut profile difference for the pan length is below the minimum consecutive undercut threshold (e.g., −0.3 meters). If the floor cut profile difference is below the minimum consecutive undercut threshold, the analysis module 954 determines that the deviation in floor cut profiles is significant (step 1014) and sets a flag associated with the pan length (step 1016). The flag, as described above, indicates that the deviation in floor cut profiles for the shear cycle is significant. Once the flag is set, the analysis module 954 determines if the end of file (i.e., the end of the horizon profile data for the shear cycle) has been reached (step 1018). Similarly, if the floor profile difference is not below the minimum consecutive undercut threshold, the analysis module 954 determines if the end of file has been reached (step 1018). If the end of file has not yet been reached, the analysis module 954 proceeds to step 1002 to identify the floor profile difference data for another pan length. When the end of file is reached, the analysis module 954 determines if any flags have been set (step 1020). If flags have been set during the shear cycles, the alert module 958 generates an alert (step 1022). If no flags were set, the analysis module 954 determines that the deviation in floor cut profiles between the previous shear cycle and the current shear cycle is not significant (step 1013).

Figure 19:
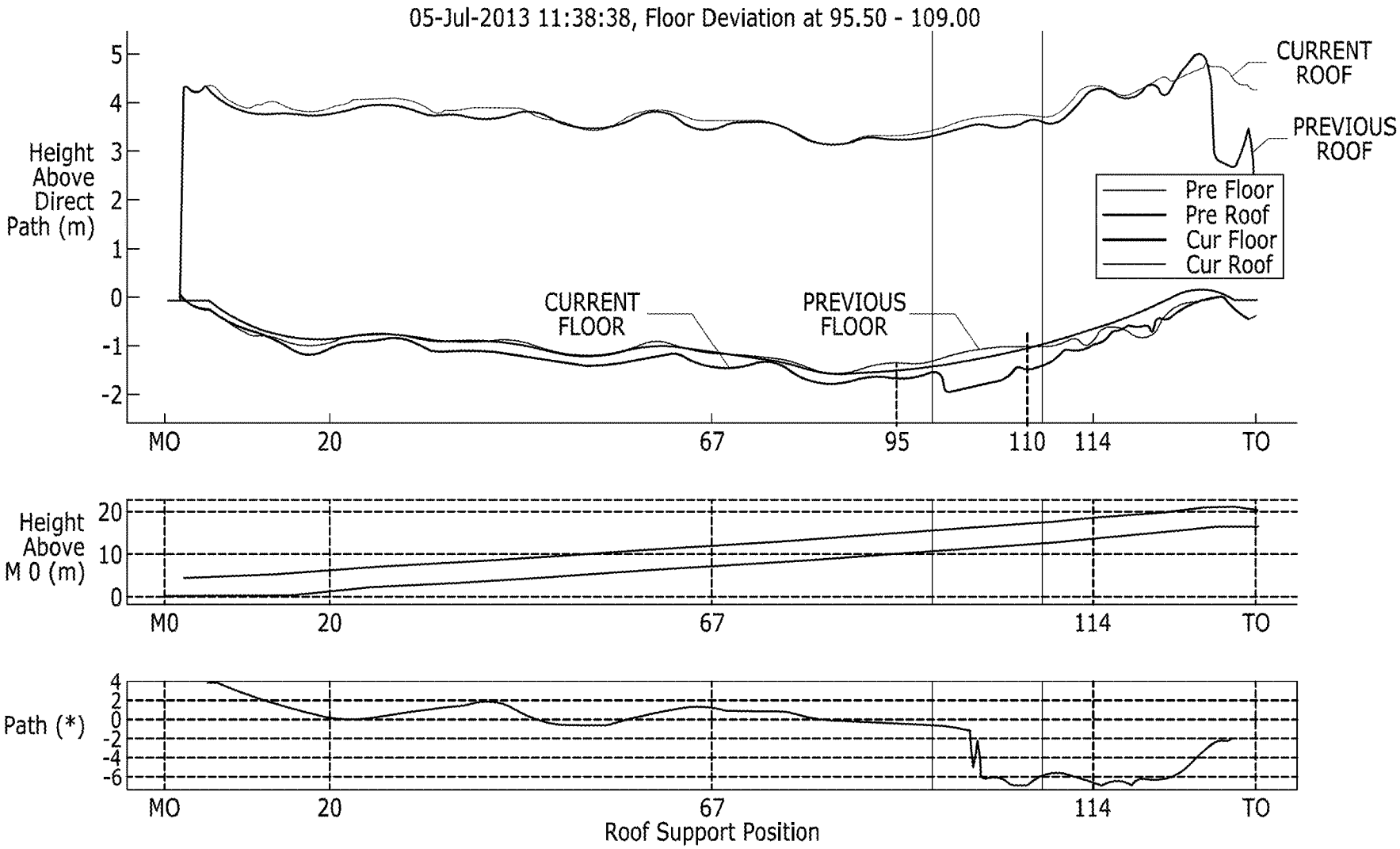
FIG. 19 is an exemplary plot including a floor cut profile of a current shear cycle and a floor cut profile of a previous shear cycle.

FIG. 19 illustrates an exemplary screenshot showing the floor cut profile for a current shear cycle (CURRENT FLOOR), the floor cut profile for a previous shear cycle (PREVIOUS FLOOR), the roof cut profile for the current shear cycle (CURRENT ROOF), and the roof cut profile for the previous shear cycle (PREVIOUS ROOF). As shown in FIG. 19, between approximately pan positions 95 and 110, the floor cut profile of the current shear cycle is much less than the floor cut profile of the previous shear cycle. In other words, the difference between the floor cut profile of the current shear cycle and the floor cut profile of the previous shear cycle is below the consecutive undercut threshold for more than the predetermined pan length (e.g., 2 pan positions). Therefore between about pan positions 95-110, the deviation in floor cut profiles is significant and an alert is generated.

In some embodiments, the deviation between the floor cut profile of a current shear cycle and the floor cut profile of a previous shear cycle can be analyzed separately for each section of the floor cut profile. For example, the analysis module 954 can first compare the difference between the two floor cut profiles to a maingate maximum consecutive floor step threshold and to a maingate minimum consecutive undercut threshold. The analysis module 954 can then compare the difference between the two floor cut profiles to a run-of-face consecutive floor step threshold and a run-of-face consecutive undercut threshold, and finally the analysis module 954 can compare the difference between the two floor cut profiles to a tailgate floor step threshold and a tailgate undercut threshold. The order in which the analysis module 954 compares the sections of the two floor cut profiles may vary.

Figure 20:
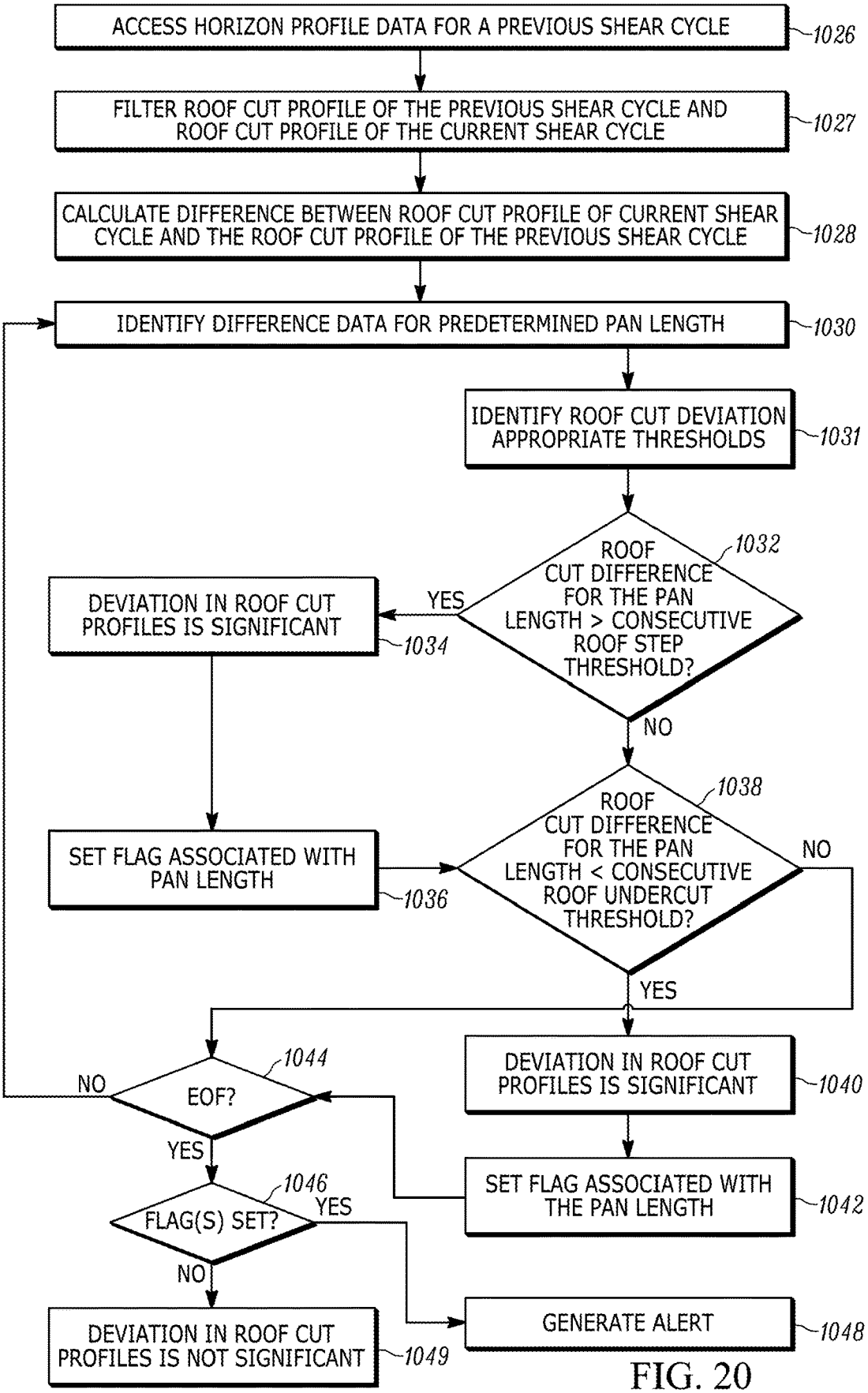
FIG. 20 illustrates a method of monitoring a consecutive roof step of two roof cut profiles.

The analysis module 954 also determines if the deviation between the roof cut profile of the current shear cycle and the roof cut profile of the previous shear cycle is significant, as shown in FIG. 20. First, at step 1026, the analysis module 954 accesses horizon profile data for a previous shear cycle. Then, the analysis module 954 filters the roof cut profile of the previous shear cycle and the roof cut profile of the current shear cycle to reduce the number of data points and thereby analyze the horizon profile data more efficiently, at step 1027. The analysis module 954 then calculates a difference between the filtered roof cut profile of a current shear cycle and the filtered roof cut profile of the previous shear cycle, at step 1028. At step 1030, the analysis module 954 identifies the roof profile difference data for a predetermined pan length. In the illustrated embodiment, the pan length corresponds to three pan positions. Then, the analysis module 954 identifies the appropriate roof cut deviation thresholds (step 1031). The appropriate roof cut thresholds may be determined based on whether the roof profile difference data for the pan length corresponds to the maingate section, the run-of-face section, or the tailgate section of the roof profiles. Again, in some embodiments, for example, when the roof cut profile data is not sectioned, the analysis module 954 may not need to identify appropriate roof cut deviation thresholds and may, instead, use the same roof cut deviation thresholds throughout the consecutive roof cut profile analysis.

The analysis module 954 then determines if the roof profile difference for the pan length is greater than a maximum consecutive roof step threshold (e.g., 0.2 meters) at step 1032. If the roof cut difference profile data is greater than the maximum consecutive roof step threshold, the analysis module 954 determines that the deviation in roof cut profiles between the current shear cycle and the previous shear cycle is significant (step 1034), and a flag is set that is associated with the analyzed pan length (step 1036). The flag indicates that the deviation of the roof cut profile between the current shear cycle and the previous shear cycle is significant. Once the flag is set, the analysis module 954 determines if the roof cut difference profile is below the minimum consecutive roof undercut threshold (e.g., −0.4 meters) at step 1038. If, however, the roof difference profile data is not greater than the maximum consecutive roof step threshold, the analysis module 954 proceeds directly to step 1038.

If the roof profile difference data for the pan length is below the minimum consecutive roof undercut threshold, the analysis module 954 determines that the deviation in roof cut profiles between the current shear cycle and the previous shear cycle is significant (step 1040) and sets a flag associated with the pan length indicating that the deviation in roof cut profiles between the two shear cycles is significant (step 1042). Once the flag is set, the analysis module 954 determines if all the roof difference profile data has been analyzed (step 1044). If the roof difference profile data is not below the minimum consecutive roof undercut threshold, the analysis module 954 determines if the end of file (i.e., the end of the roof difference profile data for the shear cycles) has been reached (step 1044). If the end of file has not been reached yet, the analysis module 954 proceeds to step 1030 to identify a different pan length and continue analyzing the roof difference profile data. When the end of file is reached and all the roof difference profile data for the two shear cycles has been analyzed, the analysis module 954 determines if any flags were set (step 1046). If flags were set, the alert module 958 generates an alert at step 1048. If flags were not set, the analysis module 954 determines that the deviation in roof cut profiles between the current shear cycle and the previous shear cycle is not significant, step 1049.

Figure 21:
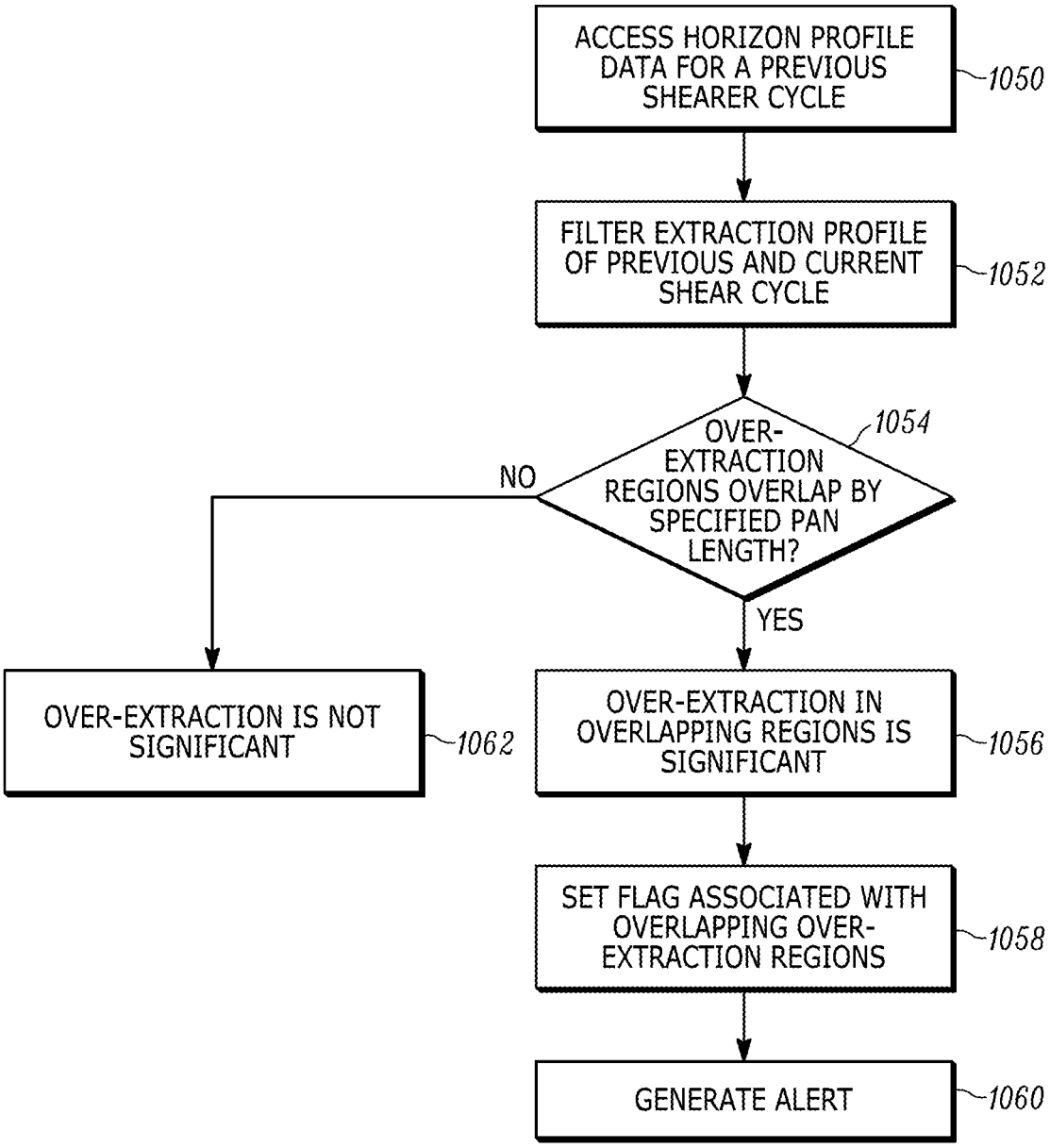
FIG. 21 illustrates a method of monitoring a consecutive over-extraction of two extraction profiles.

The analysis module 954 also determines if over-extraction occurs in the same region on consecutive shear cycles, as shown in FIG. 21. First, at step 1050, the analysis module 954 accesses horizon profile data for a previous shear cycle. In particular, the analysis module 954 accesses the extraction profile data for the previous shear cycle. Then, the analysis module 954 filters the extraction profile of the previous shear cycle and the extraction profile of the current shear cycle to reduce the number of data points and thereby analyze the horizon profile data more efficiently, at step 1052. The analysis module 954 then compares the location (e.g., a position range) of over-extraction regions (e.g., where the extraction parameter was exceeded) in the previous shear cycle to the location (e.g., position range) of over-extraction regions in the current shear cycle, at step 1054. In particular, the analysis module 954 checks if any of the over-extraction regions in the previous shear cycle overlap with any over-extraction regions in the current shear cycle by more than a predetermined pan length (e.g., 3 pan positions). If the analysis module 954 determines that an over-extraction region in the current shear cycle overlaps with an over-extraction region in the previous shear cycle, the analysis module 954 determines that the over-extraction is significant (step 1056) and a flag is set that is associated with the overlapping over-extraction regions, at step 1058. The flag indicates that at least some of the regions of the coal web are being significantly over-extracted and an alert is generated as described previously to identify the flagged regions (step 1060). If, however, the over-extraction regions of the previous shear cycle and the current shear cycle do not overlap by the predetermined pan length, or do not overlap at all, the analysis module 954 determines that over-extraction is not currently a significant problem (step 1062). In some embodiments, over-extraction is analyzed over more than just two shear cycles. For example, in some embodiments, the analysis module 954 sets a flag when over-extraction regions of more than two shear cycles (e.g., when over-extraction regions in at least three consecutive shear cycles overlap) overlap indicating that the same region of the coal web is consistently being over-extracted.

The analysis module 954 also determines if the shearer 110 is trending toward a high pitch warning level, a low pitch warning level, a high roll warning level, or a low roll warning level. Reaching the pitch and/or roll warning levels may be indicative of a position failure and may, in some situations, cause the shearer 110 to lose horizon. The high pitch warning level may be a maximum positive pitch level (e.g., 5 degrees) and the low pitch warning level may be a maximum negative pitch level (e.g., −5 degrees). Similarly, the high roll warning level may be a maximum positive roll rate change level (e.g., 0.25 degrees per pan length) and the low roll warning level may be a maximum negative roll rate change (e.g., −0.25 degrees per pan length).

Figure 22:
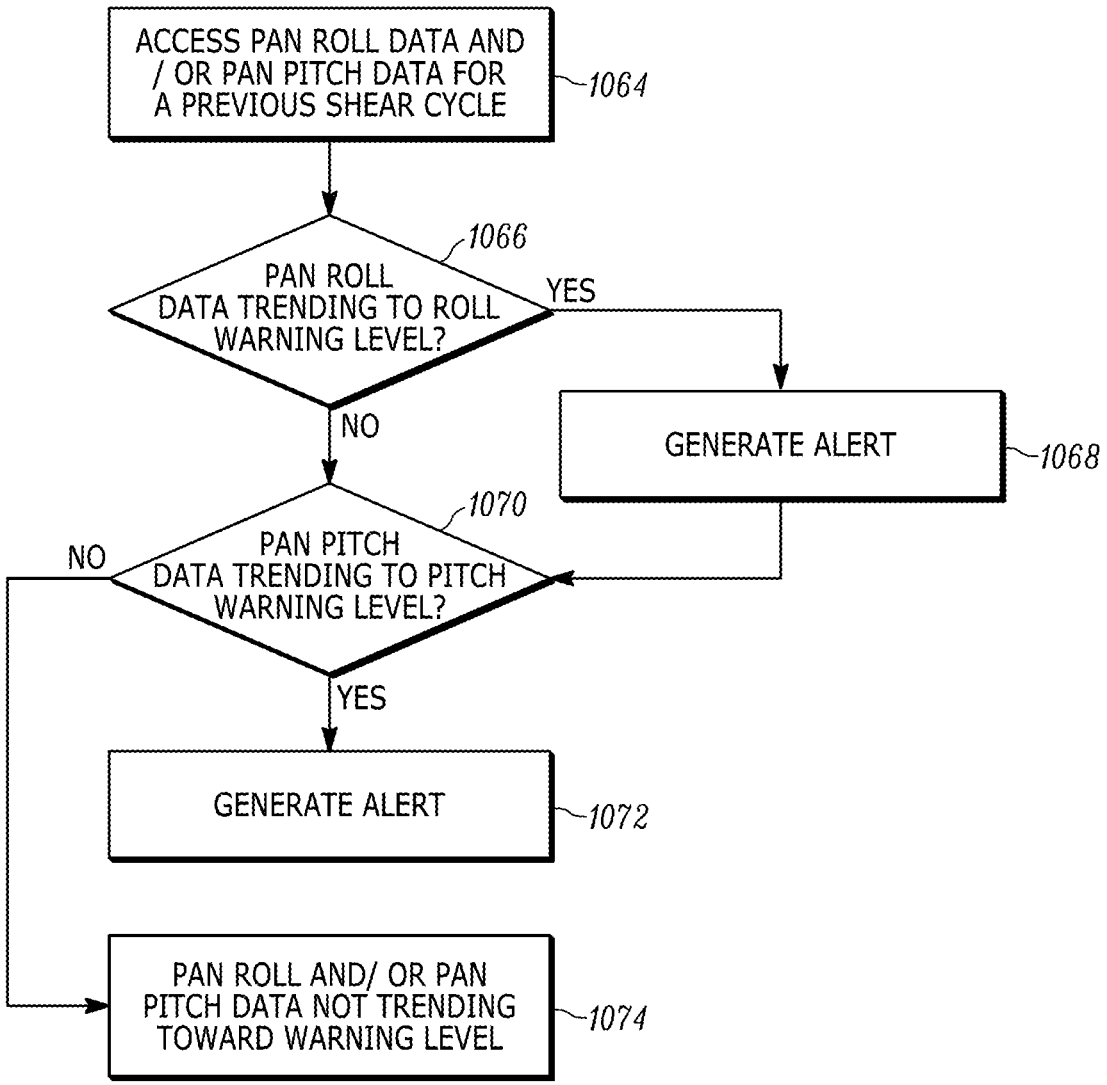
FIG. 22 illustrates a method of monitoring pan roll and pan pitch data over more than one shear cycle.

As shown in FIG. 22, at step 1064 the analysis module 954 accesses pan roll data and/or pan pitch data for a previous shear cycle. Then at step 1066, the analysis module 954 determines if the pan roll data is trending toward a roll warning level. If the pan roll data is trending toward the roll warning level, the alert module 958 generates an alert at step 1068, and the analysis module 954 continues to step 1070. If the pan roll data is not trending toward the roll warning level, the analysis module 954 determines if the pan pitch data is trending toward a pitch warning level at step 1070. If the pan pitch data is trending toward the pitch warning level, the alert module 958 generates an alert at step 1072. If the pan pitch data is not trending toward the pitch warning level, the analysis module 958 determines that the pan pitch data or both the pan pitch data and the pan roll data are not trending toward a warning level at step 1062.

The analysis module 954 may determine that the pan-line is approaching a pitch warning level or a roll warning level by, for example, determining the change in pan pitch and/or roll for more than two consecutive shear cycles. If, for example, the pan-line has a positive pitch change on consecutive shear cycles, the analysis module 954 may determine that the pan-line is trending toward the high pitch warning level. If, on the other hand, the pan-line experiences a positive pitch change and a negative pitch change, the analysis module 954 determines that the pan-line is not trending toward a high pitch warning level. If the pan-line experiences two consecutive negative pitch changes, the analysis module 954 may determine that the pan-line is trending toward the low pitch warning level. A similar procedure may be followed to determine if the pan-line is trending toward a roll warning level (e.g., the high roll warning level or a low roll warning level). If across two consecutive shear cycles the pan-line experiences two consecutive positive roll rate changes, the analysis module 954 may determine that the pan-line is approaching the high roll warning level. If, on the other hand, the pan-line experiences two consecutive negative roll changes, the analysis module 954 may determine that the pan-line is approaching the low roll warning level. If the pan-line experiences a positive roll change followed a negative roll change, the analysis module 954 may determine that the pan-line is not trending toward a roll warning level.

The analysis module 954 may additionally or alternatively determine that the pan-line is trending toward a pitch warning level by first identifying a predetermined pan length (e.g., three pan positions) for the pan pitch data of the current shear cycle and the previous shear cycle and determining if the pitch of the pan-line of the current shear cycle for the predetermined pan length is above a high pitch monitoring threshold (e.g., 4 degrees) or is below a low pitch monitoring threshold (e.g., −4 degrees). If the pitch of the pan-line of the current shear cycle is above the high pitch monitoring threshold for the predetermined pan length or below the low pitch monitoring threshold for the predetermined pan length, then the analysis module 954 calculates a difference between the pan pitch profile of the current shear cycle and the pan pitch profile of the previous shear cycle. The analysis module 954 then identifies the predetermined pan length for the pan pitch difference profile data and determines whether the pan pitch difference for the predetermined pan length is above a maximum pitch deviation threshold (e.g., 2 degrees) or is below a minimum pitch deviation threshold (e.g., −2 degrees). If the pan pitch difference for the predetermined pan length is greater than the maximum pitch deviation threshold, the analysis module 954 determines that the pitch of the shearer 110 is trending toward the high pitch warning level. If the pan pitch difference for the predetermined pan length is less than the minimum pitch deviation threshold, the analysis module 954 determines that the pitch of the shearer 110 is trending toward a low pitch warning level.

A similar procedure may be followed to determine if the pan roll rate is trending toward a high roll warning level or a low roll warning level. For example, the analysis module 954 may first identify a predetermined pan length (e.g., three pan positions) for the pan roll rate data of the current shear cycle and the previous shear cycle. The analysis module 954 then determines if the pan roll rate of the current shear cycle exceeds a high roll monitoring threshold or is below a low roll monitoring threshold for the predetermined pan length. If the pan roll of the shearer 110 during the current shear cycle for the predetermined pan length exceeds the high roll monitoring threshold or is below the low roll monitoring threshold, the analysis module 954 then determines if the deviation in pan roll rate between the current shear cycle and the previous shear cycle exceeds appropriate thresholds. For example, the analysis module 954 may calculate a difference of the pan roll rate data of the current shear cycle and the pan roll rate data of the previous shear cycle. The analysis module 954 then identifies the predetermined pan length for the pan roll rate difference data and determines whether the pan roll rate difference data for the predetermined pan length is above a maximum roll rate deviation threshold (e.g., 0.25 degrees per pan) or is below a minimum roll rate deviation threshold (e.g., −0.25 degrees per pan). If the pan roll rate difference data exceeds the maximum roll rate deviation threshold, the analysis module 954 determines that the pan roll is trending toward the high roll warning level. If the roll rate difference data is below the minimum roll rate deviation threshold, the analysis module 954 determines that the pan-line is trending toward the low roll warning level.

As explained above with reference to the pan pitch data and the pan roll data, the analysis module 954 may first determine if the pan roll data and/or the pan pitch data is above or below a monitoring threshold. Comparing the pan roll/pan pitch data to a monitoring data allows the analysis module 954 to focus on pan roll and pan pitch changes that may actually indicate that the pan-line is trending toward a pan roll or pan pitch warning level. For example, changes in pan pitch or pan roll when the pan roll/pan pitch data is below the high monitoring threshold and above the low monitoring threshold may not indicate that the shearer 110 is trending toward a pan roll or pan pitch warning level, and thus can be ignored by the analysis module 954. For example, if the pan pitch data for a predetermined pan length is −4 degrees in the previous shear cycle and 2 degrees in the current shear cycle, the analysis module 954 may ignore the high (6 degree) positive change because the pan pitch data for the predetermined pan length, −4 degrees, is not above the high pitch monitoring threshold (e.g., 12 degrees) or below the low pitch monitoring threshold (e.g., −12 degrees). The high positive change is ignored even if the deviation between the pan pitch data for the previous shear cycle and the pan pitch data for current shear cycle exceeds the high pan pitch deviation threshold (e.g., 5 degrees).

Nonetheless, in some embodiments, the analysis module 954 calculates the difference between the pan pitch profile of the current shear cycle and the pan pitch profile of the previous shear cycle or the difference between the roll rate profile of the current shear cycle and the roll rate profile of the previous cycle, without comparing the pan pitch data or the roll rate data of the current shear cycle to a monitoring threshold first. The analysis module 954 may then identify a predetermined pan length of the pan pitch and/or roll rate difference profile and determine where the pan pitch difference profile or the pan roll rate difference profile exceeds the maximum pitch deviation threshold (e.g., 2 degrees) or is below the minimum pitch deviation threshold (e.g., −2 degrees) for the predetermined pan length.

The analysis module 954 is also configured to analyze instantaneous shearer data. Instantaneous shearer data includes a stream of shearer data not necessarily segmented into data blocks corresponding to individual shear cycles. For instance, some analysis techniques discussed above include receiving shearer data, identifying a shear cycle start and end points, then analyzing the data associated with the particular shear cycle for position failures. In contrast, analysis of instantaneous shearer data is generally independent of shear cycle boundaries. Additionally, the analysis may occur in real-time. The analysis module 954 analyzes instantaneous horizon control data to determine if the roof cut is above a high roof cut threshold, if the floor cut is below a low floor cut threshold, and if the shearer pitch angle in above or below a pitch angle threshold.

Figure 23:
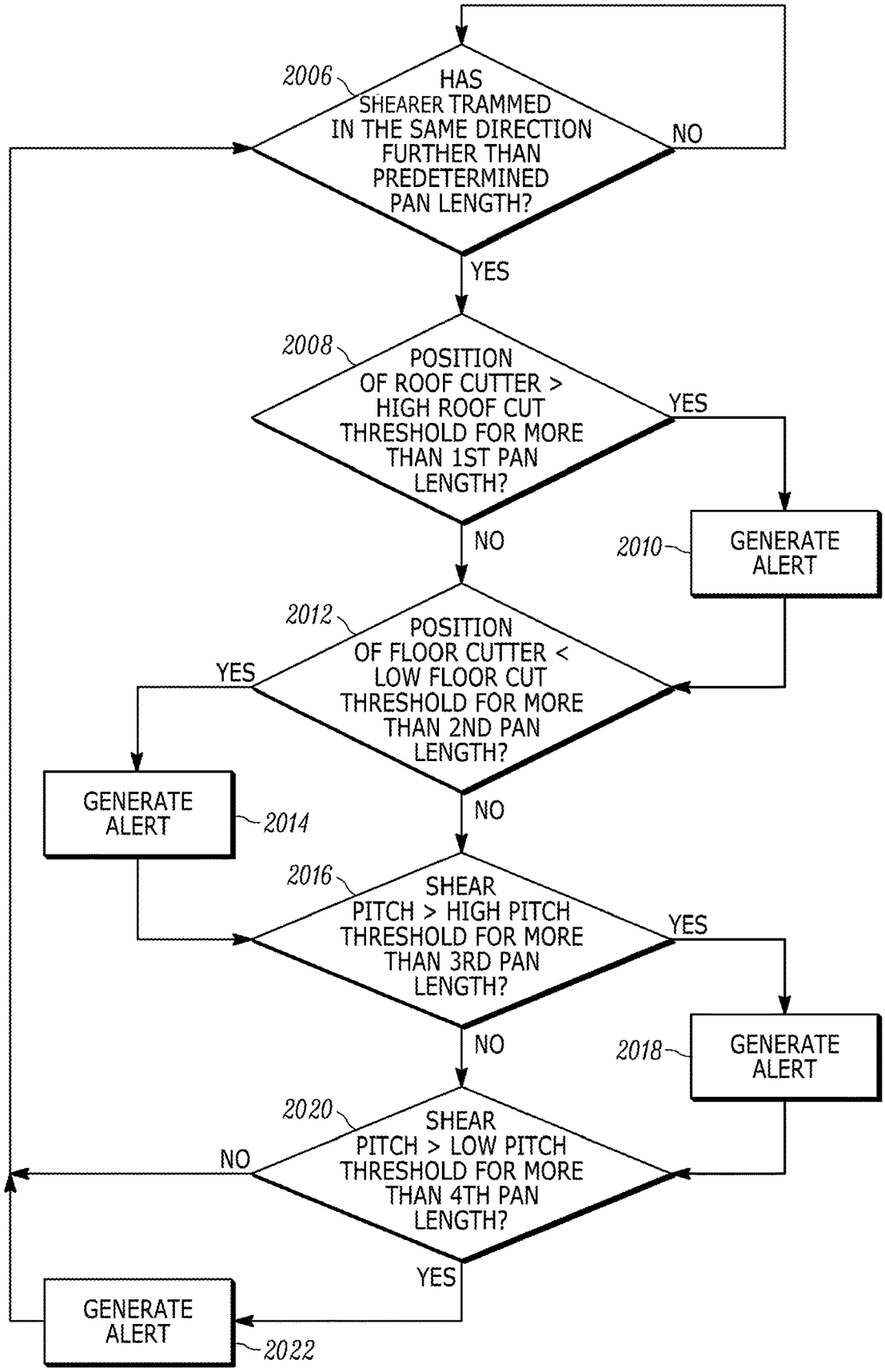
FIG. 23 illustrates a method of analyzing instantaneous horizon data.

FIG. 23 illustrates a method implemented by the analysis module 954 to analyze instantaneous horizon data. At step 2006, the analysis module 954 first determines if the shearer 110 has trammed in the same direction for a predetermined number of pans (i.e., pan length or number of pan positions). The analysis module 954 generally does not analyze the roof cut or the floor cut unless the shearer 110 trams in the same direction for the predetermined pan length. When the analysis module 954 determines that the shearer 110 has advanced in the same direction for the predetermined pan length, the analysis module 954 then determines if the position of the cutting picks 245 on either cutter drum (i.e., one of the right cutter 235 and left cutter 240) exceeds a high roof cut threshold for the first predetermined pan length (e.g., 5 pan positions) at step 2008. If the cutting picks 245 of either cutter drum 235, 240 are above the high roof cut threshold, the alert module 958 generates an alert message at step 2010. However, if the cutting picks 245 of either cutter drum 235, 240 only briefly rise above the high roof cut threshold (e.g., for less than the first predetermined pan length) or does not rise above the high roof cut threshold at all, the analysis module 954 proceeds to step 2012.

The analysis module 954 then determines if cutting picks 245 of either cutter drum 235 or 240) are below a low floor cut threshold for more than a second pan length (e.g., 5 pan positions) at step 2012. If the cutting picks 245 of either cutter drum 235, 240 are below the low floor cut threshold for further than the second pan length, the alert module 958 generates an alert message at step 2014 and the analysis module 954 proceeds to step 2016. If the cutting picks 245 of either cutter drum 235, 240 are not below the low floor cut threshold for further than the second pan length (e.g., are below the low floor cut threshold for less than the second pan length or are not below the low floor cut threshold at all), the analysis module 954 proceeds directly to step 2016.

The analysis module 954 also determines if the pitch of the shearer 110 exceeds a high pitch threshold (e.g., 6 degrees) for further than a third pan length at step 2016. If the pitch of the shearer 110 exceeds the high pitch threshold, the alert module 958 generates an alert at step 2018 and the analysis module 954 then proceeds to step 2020. If the pitch of the shearer 110 does not exceed the high pitch threshold, the analysis module 954 proceeds directly to step 2020. The analysis module 954 also determines if the pitch of the shearer 110 is below a low pitch threshold (e.g., −6 degrees) for further than a fourth pan length at step 20240. If the analysis module 954 determines that the pitch of the shearer 110 remains below the low pitch threshold for further than the fifth predetermined pan length, the alert module 958 generates the alert at step 2026. If the pitch of the shearer 110 is not below the low pitch threshold, the analysis module 954 goes back to step 2006 and continues to monitor the instantaneous shearer data. One or more of the first, second, third, fourth, and fifth predetermined pan lengths may be the same (e.g., 5 pan positions) or different depending on the parameter being analyzed.

In some embodiments, the analysis module 954 checks each of the above conditions for each set of shearer data that the analysis module 954 receives. Similarly, although the steps in FIGS. 14-23 are shown as occurring serially, one or more of the steps are executed simultaneously in some instances. For example, the analyzing steps of FIG. 23 may occur simultaneously such that all the conditions are checked for each set of shearer data. In some embodiments, the shearer data is received by the analysis module 954 in a regular time interval (e.g., every 5-15 minutes).

Figure 24:
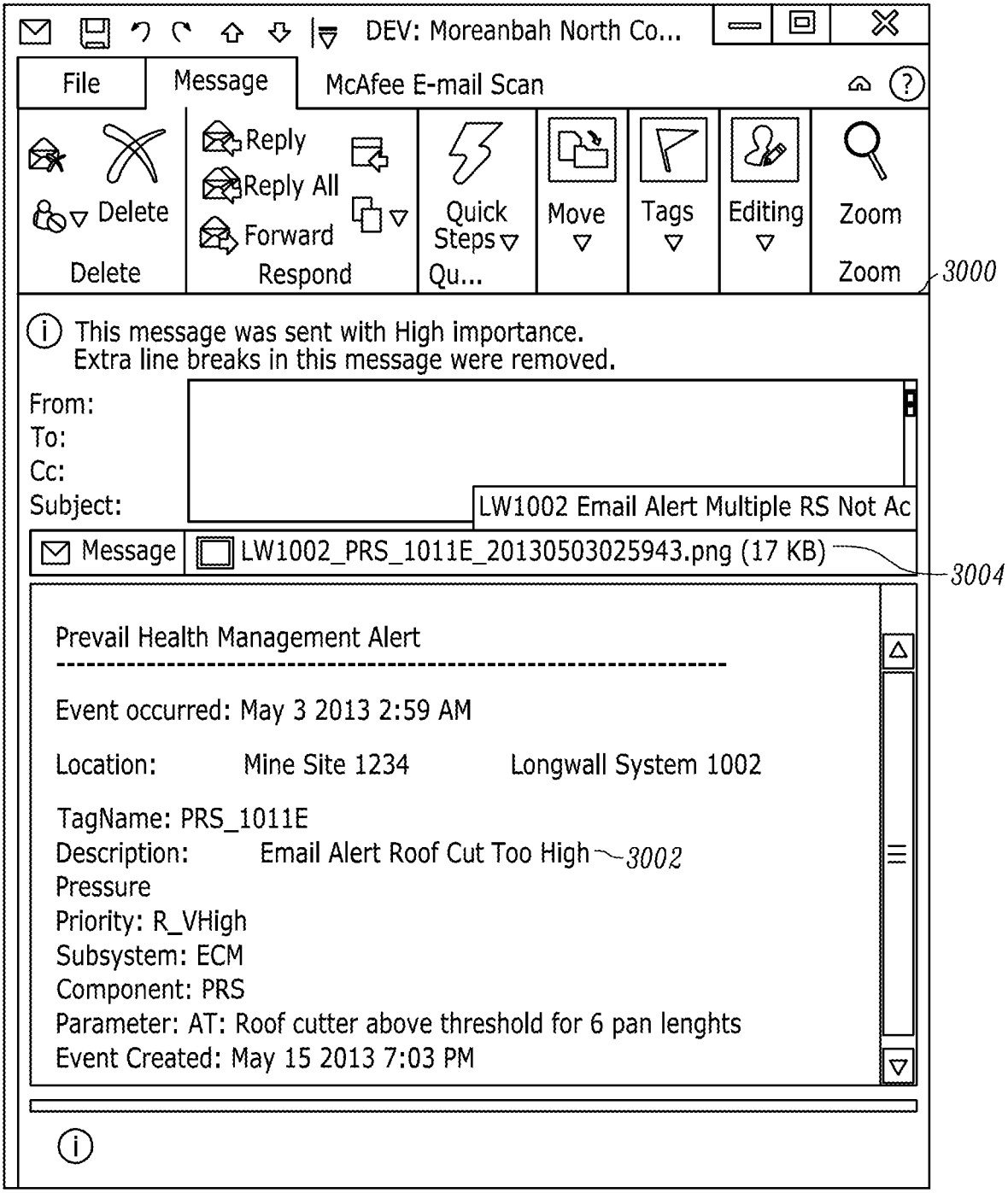
FIG. 24 illustrates an exemplary e-mail alert.

The alert generated by the alert module 958 when instantaneous shearer data is analyzed is presented to a participant. FIG. 24 illustrates an example email alert 3000 that may be sent out to one or more designated participants (e.g., service personnel at a service center 725, personnel underground or above ground at the mine site, etc.). The email alert 3000 includes text 3002 with general information about the alert, including when the event occurred, a location of the event, an indication of the parameter associated with the event (e.g., high roof cut profile), and when the event/alert was created.

The e-mail alert 3000 also includes an attached image file 3004. In the illustrated embodiment, the attached image file 3004 is a Portable Network Graphic (.png) file, including a graphic depiction to assist illustration of the event or scenario causing the alert. For example, when the analysis module 954 identifies the shear cycle before analyzing the horizon data, the attached image file 3004 can include an image similar to FIG. 12, which shows the roof cut profile for the shear cycle, the floor cut profile for the shear cycle, the pan line for the shear cycle, the pitch profile for the shear cycle, and the elevation profile for the shear cycle. A portion of the image can be highlighted to more particularly point the section during which an alert was generated.

In some instances, a generated alert takes another form or includes further features. For example, an alert generated by the alert module 958 can also include an instruction sent to one or more components of the longwall mining system 100 (e.g., to the longwall shearer 110) to safely shut down.

Additionally, alerts generated by the alert module 958 can have different priority levels depending on the particular alert (e.g., depending on which parameters triggered the alert). Generally, the higher the priority the more severe the alert. For example, a high priority alert can include automatic instructions to shut down the entire longwall mining system 100 while a low priority alert may just be included in a daily report log.

It should be noted that one or more of the steps and processes described herein can be carried out simultaneously, as well as in various different orders, and are not limited by the particular arrangement of steps or elements described herein. In some embodiments, the health monitoring system 700 can be used by various longwall mining-specific systems, as well as by various other industrial systems not necessarily particular to longwall or underground mining.

It should be noted that as the remote monitoring system 720 runs the analyses described with respect to FIGS. 14-18 and 20-23, other analyses, whether conducted on shearer data or other longwall component system data, can be executed by either the processor 721 or other designated processors of the system 700. For example, the system 720 can run analyses on monitored parameters (collected data) from other components of the longwall mining system 100. In some instances, for example, the remote monitoring system 720 can analyze data collected from the sensors 260, 265, 270, 275, 280 and generate alerts. Such alerts can include high or low floor cuts, high or low pan pitch, and the like, and include detailed information regarding a situation that triggers the alert.

Thus, the invention provides, among other things, systems and methods for monitoring a longwall shearing mining machine in a longwall mining system. Various features and advantages of the invention are set forth in the following claims.

What is claimed is:

1. A monitoring device for a longwall mining system including a shearer having a first cutter drum and a second cutter drum, the monitoring device comprising:

a memory; and an electronic processor coupled to the memory and in communication with the shearer, the electronic processor configured to receive shearer position data from a shearer sensor configured to determine a position of at least one selected from the group of the shearer, the first cutter drum, and the second cutter drum;

identify from the shearer position data, a first transition point indicative of a start point of a discrete shear cycle;

identify, from the shearer position data, a second transition point indicative of an end point of the discrete shear cycle;

generate profile data for the discrete shear cycle based on the shearer position data, the first transition point, and the second transition point; and generate an alert, for display on a display screen, based on analysis of the profile data.

2. The monitoring device of claim 1, wherein the electronic processor is configured to identify the first transition point indicative of the start point and the second transition point indicative of the end point based on identifying from the shearer position data at least one selected from a group consisting of a turn point of the shearer, a change of direction of the shearer, a change in height of the first cutter drum, and a change in height of the second cutter drum.

3. The monitoring device of claim 1, wherein the shearer position data includes a time series data set including at least one selected from the group of a position of the shearer, a height of the first cutter drum, and the height of the second cutter drum sensed relative to time, and the electronic processor is configured to identify the first transition point indicative of the start point and the second transition point indicative of the end point from respective inflection points in the time series data set.

4. The monitoring device of claim 1, wherein the electronic processor is included in at least one of the group consisting of a cloud computing device, a local computing device, and a mobile computing device.

5. The monitoring device of claim 1, wherein the discrete shear cycle corresponds to a series of shear movements implemented by a shearing mining machine to extract one web of coal.

6. A method of monitoring a longwall shearing mining machine in a longwall mining system including a shearer having a first cutter drum and a second cutter drum, the method comprising:

receiving, by an electronic processor, shearer position data from a shearer sensor configured to determine a position of at least one selected from the group of the shearer, the first cutter drum, and the second cutter drum;

identifying, by the electronic processor, from the shearer position data, a first transition point indicative of a start point of a discrete shear cycle;

identifying, by the electronic processor, from the shearer position data, a second transition point indicative of an end point of the discrete shear cycle;

generating profile data, by the electronic processor, for the discrete shear cycle based on the shearer position data, the first transition point, and the second transition point; and generating an alert, for display on a display screen, based on analysis of the profile data.

7. The method of claim 6, wherein identifying the first transition point indicative of the start point and identifying the second transition point indicative of the end point are based on identifying, from the shearer position data, at least one selected from a group consisting of a turn point of the shearer, a change of direction of the shearer, a change in height of the first cutter drum, and a change in height of the second cutter drum.

8. The method of claim 6, wherein the shearer position data includes a time series data set including at least one selected from the group of a position of the shearer, a height of the first cutter drum, and the height of the second cutter drum sensed relative to time, and wherein identifying the first transition point indicative of the start point and the second transition point indicative of the end point are based on identifying respective inflection points in the time series data set.

9. The method of claim 6, wherein the shearer position data includes a time series data set including at least one selected from the group of a position of the shearer, a height of the first cutter drum, and the height of the second cutter drum sensed relative to time, and wherein identifying the first transition point indicative of the start point and the second transition point indicative of the end point are based on searching the time series data set for minima and maxima corresponding to gate shuffle points.

10. The method of claim 6, wherein the discrete shear cycle is a current shear cycle and further comprising accessing profile data obtained over a previous shear cycle, and comparing the profile data of the previous shear cycle to the profile data of the current shear cycle.

11. The method of claim 10, wherein the profile data includes a shear cycle position profile based on the start point and the end point for the current shear cycle, and wherein the electronic processor is configured to determine whether a difference between the shear cycle position profile of the previous shear cycle and the shear cycle position profile of the current shear cycle exceeds a predetermined threshold.

12. The method of claim 10, wherein the alert is generated in response to the difference between the profile data of the current shear cycle and the profile data of the previous shear cycle exceeding a predetermined threshold.

13. The method of claim 10, wherein the electronic processor is configured to filter the profile data to reduce a number of data points to be analyzed as profile data.

14. The method of claim 13, wherein filtering the profile data includes setting the data point to be analyzed to one selected from a group consisting of an average value of consecutive data points, a greatest value of consecutive data points, a lowest value of consecutive data points, and a median value of consecutive data points.

15. The method of claim 6, wherein the electronic processor is included in at least one of the group consisting of a cloud computing device, a local computing device, and a mobile computing device.

16. A longwall mining system comprising:

a shearer including a first cutter drum;

a second cutter drum;

a shearer sensor configured to determine a position of at least one selected from the group of the shearer, the first cutter drum, and the second cutter drum; and an electronic processor in communication with the shearer, the processor configured to:

receive shearer position data from the shearer sensor;

identify, from the shearer position data, a first transition point indicative of a start point of a discrete shear cycle;

identify, from the shearer position data, a second transition point indicative of an end point of the discrete shear cycle;

generate profile data for the discrete shear cycle based on the shearer position data, the first transition point, and the second transition point; and generating an alert based on analysis of the profile data.

17. The longwall mining system of claim 16, wherein, to identify the first transition point indicative of the start point and identify the second transition point indicative of the end point, the electronic processor is configured to identify, from the shearer position data, at least one selected from a group consisting of a turn point of the shearer, a change of direction of the shearer, a change in height of the first cutter drum, and a change in height of the second cutter drum.

18. The longwall mining system of claim 16, wherein the shearer position data includes a time series data set including at least one selected from the group of a position of the shearer, a height of the first cutter drum, and the height of the second cutter drum sensed relative to time, and wherein, to identify the first transition point indicative of the start point and the second transition point indicative of the end point, the electronic processor is configured to identify respective inflection points in the time series data set.

19. The longwall mining system of claim 16, wherein the shearer position data includes a time series data set including at least one selected from the group of a position of the shearer, a height of the first cutter drum, and the height of the second cutter drum sensed relative to time, and wherein, to identify the first transition point indicative of the start point and the second transition point indicative of the end point, the electronic processor is configured to search the time series data set for minima and maxima corresponding to gate shuffle points.

20. The longwall mining system of claim 16, wherein the electronic processor is included in at least one of the group consisting of a cloud computing device, a local computing device, and a mobile computing device.

* * * * *